US010921729B2

(12) United States Patent
Shimizu et al.

(10) Patent No.: US 10,921,729 B2
(45) Date of Patent: Feb. 16, 2021

(54) IMAGE FORMING APPARATUS

(71) Applicant: KYOCERA Document Solutions Inc., Osaka (JP)

(72) Inventors: Tamotsu Shimizu, Osaka (JP); Yasushi Imanishi, Osaka (JP); Satoshi Sunayama, Osaka (JP); Kazuhiro Nakachi, Osaka (JP); Ai Takagami, Osaka (JP); Kanako Kikuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/583,430

(22) Filed: Sep. 26, 2019

(65) Prior Publication Data

US 2020/0103785 A1 Apr. 2, 2020

(30) Foreign Application Priority Data

Sep. 27, 2018 (JP) ..... JP2018-181209

(51) Int. Cl.
*G03G 15/06* (2006.01)

(52) U.S. Cl.
CPC ..... *G03G 15/065* (2013.01)

(58) Field of Classification Search
None
See application file for complete search history.

(56) References Cited

U.S. PATENT DOCUMENTS

| | | | | |
|---|---|---|---|---|
| 6,798,999 | B2 | 9/2004 | Itagaki et al. | |
| 2003/0219266 | A1 | 11/2003 | Itagaki et al. | |
| 2013/0028621 | A1* | 1/2013 | Furukawa | G03G 15/06 399/55 |
| 2019/0129328 | A1* | 5/2019 | Watanabe | G03G 15/0844 |
| 2020/0073308 | A1* | 3/2020 | Shimizu | G03G 15/5037 |
| 2020/0103785 | A1* | 4/2020 | Shimizu | G03G 15/065 |

FOREIGN PATENT DOCUMENTS

| | | | |
|---|---|---|---|
| JP | 2003-345075 | A | 12/2003 |
| JP | 2004-037952 | A | 2/2004 |
| JP | 2004037952 | A * | 2/2004 |
| JP | 4480066 | B2 | 6/2010 |
| JP | 5024192 | B2 | 9/2012 |
| JP | 5273542 | B2 | 8/2013 |

* cited by examiner

*Primary Examiner* — Sevan A Aydin
(74) *Attorney, Agent, or Firm* — Studebaker & Brackett PC

(57) ABSTRACT

A mode controller outputs a characteristic value according to a DC component of a developing current measured by an ammeter at a predetermined measurement timing. The measurement timing is defined as a timing at which a non-image forming region of a surface of a photosensitive drum is located opposite to a developing roller in the entirety of an axial direction and an electric field in a direction in which a toner moves from the photosensitive drum toward the developing roller by a potential difference between a surface potential of the photosensitive drum and the DC component of a developing bias is formed in a developing nip part. A determining section determines an execution timing for a charge amount acquisition operation according to the characteristic value output by the mode controller.

16 Claims, 11 Drawing Sheets

IMAGE FORMING APPARATUS

INCORPORATION BY REFERENCE

The present application claims priority under 35 U.S.C. § 119 to Japanese Patent Application No. 2018-181209, filed on Sep. 27, 2018. The contents of this application are incorporated herein by reference in their entirety.

BACKGROUND

The present disclosure relates to an image forming apparatus for forming an image on a sheet.

Image forming apparatuses for forming an image on a sheet are known. Such an image forming apparatus includes, for example, a photosensitive drum (image bearing member), a developing device, and a transfer member. An electrostatic latent image formed on the photosensitive drum is made visible by the developing device in a developing nip part, and thus a toner image is formed on the photosensitive drum. The toner image is transferred onto a sheet by the transfer member. A two-component developing technology using a developer containing a toner and a carrier is known as being applicable to such an image forming apparatus.

The two-component developing exhibits a phenomenon in which the developer degrades as a result of being influenced by the number of sheets on which image formation has been made, environmental changes, an image formation mode (number of sheets on which image formation has been made consecutively per job), the coverage rate, and the like. As a result, a charge amount of the toner is changed. This causes problems of a decrease in image density, occurrence of toner fogging, an increase in amount of scattering toner, and the like. In order to deal with these problems, technologies are occasionally adopted that suppress a decrease in image density, an increase in the toner fogging, and an increase in toner scattering by adjusting a toner density, a developing bias, a surface potential of the photosensitive member, a rotation rate of a developing roller, an output of a suction fan that collects the scattering toner, or the like through prediction of a change in the charge amount of the developer based on the number of sheets on which image formation has been made, the environmental changes, the image formation mode, the coverage rate, and the like.

However, such a technology predicts the charge amount of the developer by a mere combination of predictions under individual conditions of the number of sheets on which image formation has been made, the environmental changes, the image formation mode, and the coverage rate. In the case where the plurality of conditions are changed in various manners, it is difficult to predict the charge amount of the developer sufficiently properly.

In such a situation, a technology that predicts the charge amount of the toner more accurately is occasionally adopted. According to such a technology, for example, a surface potential of the photosensitive drum before development and a surface potential of a toner layer on the photosensitive drum after development are measured. Separately, based on results of measurement on the image density of the toner layer formed as a result of the development, the amount of the toner used for the development is calculated. Based on the measured surface potentials and the amount of the toner used for the development, the charge amount of the toner is calculated.

According to another technology such as above, for example, a value of an electric current flowing into the developing roller that bears the developer is measured. The measured value of the electric current is assumed to be an amount of electric charge of the toner moved from the developing roller to the photosensitive drum. Based on the results of measurement on the image density of the toner layer formed as a result of the development, the amount of the toner used for the development is calculated. Based on the amount of electric charge of the toner and the amount of the toner used for the development, the charge amount of the toner is calculated.

SUMMARY

An image forming apparatus according to an aspect of the present disclosure includes: an image bearing member that is rotatable, that allows an electrostatic latent image to be formed on a surface thereof, and that bears a toner image obtained as a result of the electrostatic latent image being made visible; a charger charging the image bearing member with a predetermined charge potential; an exposure device that exposes the surface of the image bearing member charged with the predetermined charge potential to light according to predetermined image information to form the electrostatic latent image; a developing device located opposite to the image bearing member in a predetermined developing nip part, the developing device including a developing roller that is rotatable, that bear a developer containing a toner and a carrier on a circumferential surface thereof and that supplies the toner to the image bearing member having the electrostatic latent image formed thereon to form the toner image; a developing bias applying section that applies a developing bias including an AC voltage superposed on an DC voltage to the developing roller; a density detecting section that detects a density of the toner image; a developing current measuring section that measures a DC component of a developing current flowing between the developing roller and the developing bias applying section; storage that stores predetermined information thereon; a charge amount acquiring section that controls the charger, the exposure device, and the developing bias applying section at a predetermined execution timing during a non-development operation time period, different from a development operation time period in which the toner image is formed on the image bearing member, to form a plurality of measurement toner images developed with different amounts of the toner from each other on the image bearing member, and that executes a charge amount acquisition operation of acquiring a charge amount of the toner contained in each of the plurality of measurement toner images formed on the image bearing member, based on the density of each of the plurality of measurement toner images detected by the density detecting section, or based on a DC component of the developing current measured by the developing current measuring section at the time of formation of the plurality of measurement toner images as well as based on the density of each of the plurality of measurement toner images; a characteristic value outputting section that acquires the DC component of the developing current, measured by the developing current measuring section, at a predetermined measurement timing, at which a non-image forming region of the surface of the image bearing member is opposite to the developing roller in the entirety of an axial direction and an electric field in a direction in which the toner moves from the image bearing member toward the developing roller by a potential difference between a surface potential of the image bearing member and the DC component of the developing bias is formed in the developing nip part, and that outputs a characteristic value according to the DC component of the developing current; and an execution timing determining section that determines the execution timing for the charge amount acquisition operation according to the characteristic value output by the characteristic value outputting section.

DETAILED DESCRIPTION

Hereinafter, an image forming apparatus 10 according to an embodiment of the present disclosure will be described in detail with reference to the drawings. In the present embodiment, a tandem color printer will be provided as an example of the image forming apparatus 10. The image forming apparatus 10 may be, for example, a copier, a facsimile, a multifunction peripheral having functions of such apparatuses, or the like. Alternatively, the image forming apparatus 10 may be, for example, an apparatus that forms a single-color (monochromatic) image.

Figure 1:
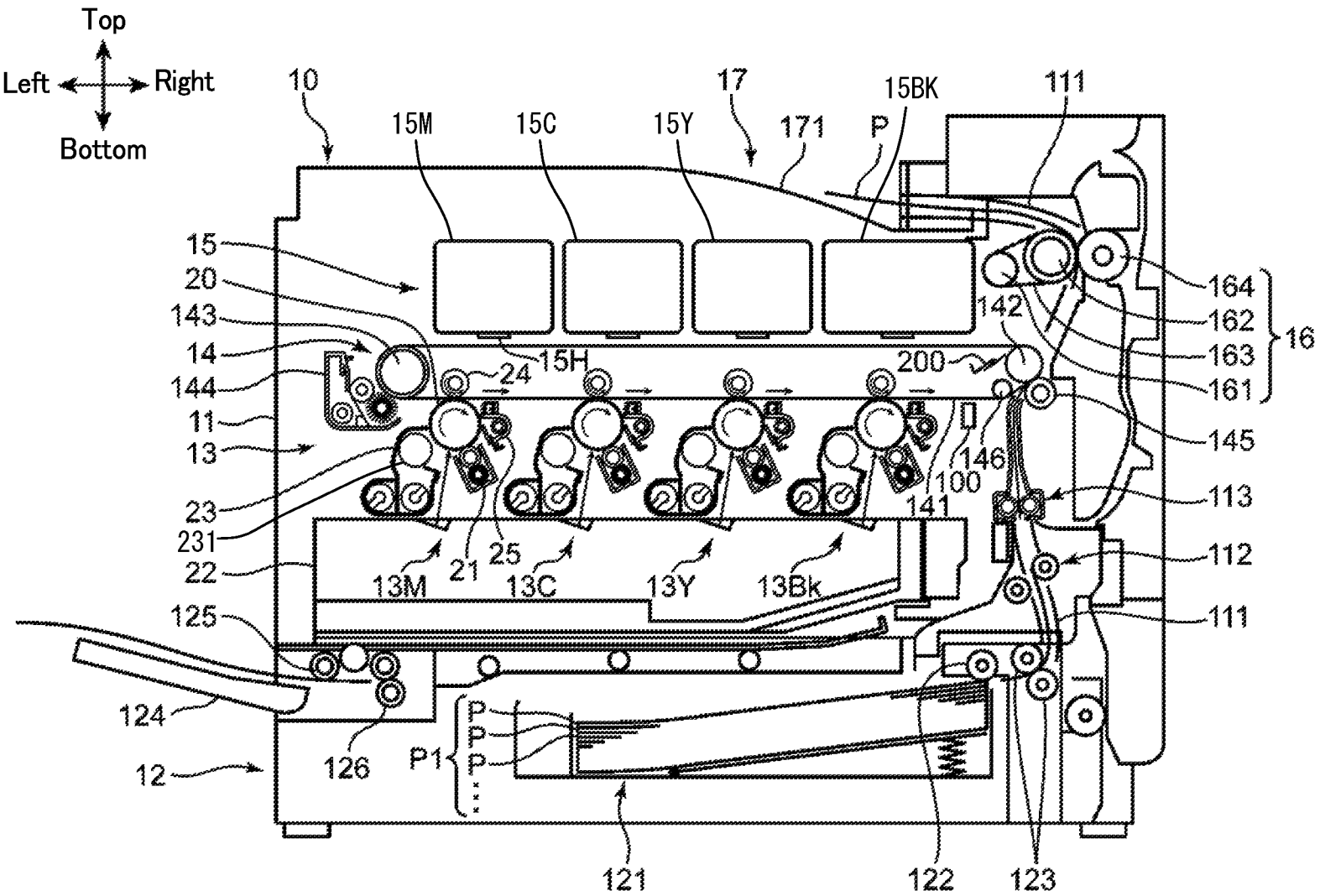
FIG. 1 is a cross-sectional view illustrating an internal configuration of an image forming apparatus according to an embodiment of the present disclosure.

FIG. 1 is a cross-sectional view illustrating an internal configuration of the image forming apparatus 10. The image forming apparatus 10 includes a main body 11 having a box-like housing structure. The main body 11 accommodates a sheet feed section 12, an image forming section 13, an intermediate transfer unit 14, a toner replenishment section 15, and a fixing section 16. The sheet feed section 12 feeds a sheet P. The image forming section 13 forms a toner image to be transferred onto the sheet P fed from the sheet feed section 12. To the intermediate transfer unit 14, the toner image is primarily transferred. The toner replenishment section 15 replenishes the image forming section 13 with a toner. The fixing section 16 performs a process of fixing an unfixed toner image, formed on the sheet P, onto the sheet P. In a top part of the main body 11, an ejection section 17 is provided. To the ejection section 17, the sheet P having the toner image fixed thereon by the fixing section 16 is ejected.

An operation panel (not illustrated) to which output conditions on the sheet P or the like are to be input is provided at an appropriate position on a top surface of the main body 11. The operation panel includes a display device that displays information, such as a liquid crystal device, a power key, a touch panel through which the output conditions are to be input, and various operation keys.

The main body 11 further accommodates a sheet conveyance path 111, extending in an up-down direction, at a position to the right of the image forming section 13. The sheet conveyance path 111 is provided with a conveyance roller pair 112, conveying the sheet P, at an appropriate position. A resist roller pair 113 is provided on the sheet conveyance path 111, at a position upstream with respect to a nip part for secondary transfer. The resist roller pair 113 performs skew correction on the sheet P, and feeds the sheet P to the nip part at a predetermined timing. The nit part will be described later. The sheet conveyance path 111 conveys the sheet P from the sheet feed section 12 to the ejection section 17 via the image forming section 13 and the fixing section 16.

The sheet feed section 12 includes a sheet feed tray 121, a pickup roller 122, and a sheet feed roller pair 123. The sheet feed tray 121 is detachably attached at a position in a bottom part of the main body 11, and stores a sheet stack P1 including a plurality of sheets P stacked therein. The pickup roller 122 feeds the sheets P in the sheet stack P1 stored in the sheet feed tray 121 one by one from the uppermost sheet P. The sheet feed roller pair 123 feeds the sheet P fed by the pickup roller 122 onto the sheet conveyance path 111.

The sheet feed section 12 includes a manual sheet feed section attached to a left side surface (in FIG. 1) of the main body 11. The manual sheet feed section includes a manual feed tray 124, a pickup roller 125, and a sheet feed roller pair 126. On the manual feed tray 124, a sheet P manually provided is to be loaded. When the sheet P is to be provided manually, the manual feed tray 124 is located to protrude from the side surface of the main body 11 as illustrated in FIG. 1. The pickup roller 125 feeds the sheet P loaded on the manual feed tray 124. The sheet feed roller pair 126 feeds the sheet P fed by the pickup roller 125 onto the sheet conveyance path 111.

The image forming section 13 forms a toner image to be transferred onto the sheet P. The image forming section 13 includes a plurality of image forming units respectively forming toner images of different colors. In the present embodiment, the image forming units include a magenta unit 13M using a magenta (M) developer, a cyan unit 13C using a cyan (C) developer, a yellow unit 13Y using a yellow (Y) developer, and a black unit 13Bk using a black (Bk) developer, which are arrayed sequentially above an intermediate transfer belt 141 (described later) from upstream to downstream in a circulation direction of the intermediate transfer belt 141 (from left to right in FIG. 1). Each of the units 13M, 13C, 13Y, and 13Bk includes a photosensitive drum 20, a charger 21, a developing device 23, a primary transfer roller 24, and a cleaner 25 located around the photosensitive drum 20. An exposure device 22 common to the units 13M, 13C, 13Y, and 13Bk is located below the image forming units. The photosensitive drum 20 is an example of "image bearing member". Hereinafter, descriptions regarding the image forming units will be basically made on one image forming unit for the sake of simplicity.

The photosensitive drum 20 is driven to rotate about an axis thereof. The photosensitive drum 20 has an electrostatic latent image formed on a surface thereof, and bears a toner image formed as a result of the electrostatic latent image being made visible. The photosensitive drum 20 may be, for example, an amorphous silicon (α-Si) photosensitive drum or an organic photosensitive drum (organic photoconductor (OPC)).

The charger 21 charges the surface of the photosensitive drum 20 uniformly to a predetermined charge potential. The charger 21 includes a charging roller and a charging cleaning brush for removing toner attached to the charging roller.

The exposure device 22 is located opposite to the photosensitive drums 20 with an exposure optical path therebetween. The exposure optical path is located downstream, in a rotation direction of the photosensitive drum 20, with respect to the charger 21. The exposure device 22 accommodates various optical elements such as a light source, a polygon mirror, a reflective mirror, a deflecting mirror. The exposure device 22 directs light, modulated based on image data, toward the surface of the photosensitive drum 20 charged uniformly to the predetermined charge potential to form an electrostatic latent image. The image data is an example of "predetermined image information".

The developing device 23 is located opposite to the photosensitive drum 20 in a predetermined developing nip part NP (FIG. 3A), which is located downstream, in the rotation direction of the photosensitive drum 20, with respect to the exposure optical path of the exposure device 22. The developing device 23 includes a rotatable developing roller 231. The developing roller 231 bears the developer, which contains a toner and a carrier, on a circumferential surface thereof, and supplies the toner to the photosensitive drum 20 to form the toner image.

The primary transfer roller 24 forms the nip part together with the photosensitive drum 20 with the intermediate transfer belt 141 included in the intermediate transfer unit 14 therebetween. The primary transfer roller 24 primarily transfers the toner image on the photosensitive drum 20 onto the intermediate transfer belt 141. The cleaner 25 cleans a circumferential surface of the photosensitive drum 20 after the toner image is transferred onto the intermediate transfer belt 141.

The intermediate transfer unit 14 is located in a space between the image forming section 13 and the toner replenishment section 15. The intermediate transfer unit 14 includes the intermediate transfer belt 141, a drive roller 142 rotatably supported by a unit frame (not illustrated), a driven roller 143, a backup roller 146, and a density sensor 100. The intermediate transfer belt 141 is endless. The intermediate transfer belt 141 is a belt-like member capable of circulating. The intermediate transfer belt 141 is extended between the drive roller 142, the backup roller 146, and the driven roller 143 such that an outer surface of the intermediate transfer belt 141 is in contact with the circumferential surfaces of the photosensitive drums 20. The intermediate transfer belt 141 is driven to circulate by the rotation of the drive roller 142. In the vicinity of the driven roller 143, a belt cleaner 144 for removing toner remaining on the outer surface of the intermediate transfer belt 141 is disposed. The density sensor 100 is located opposite to the intermediate transfer belt 141 at a position downstream with respect to the units 13M, 13C, 13Y, and 13Bk. The density sensor 100 detects a density of the toner image formed on the intermediate transfer belt 141. In other embodiments, the density sensor 100 may detect the density of the toner image on the photosensitive drum 20 or detect the density of the toner image fixed onto the sheet P. The density sensor 100 is an example of "density detecting section".

A secondary transfer roller 145 is disposed outside the intermediate transfer belt 141 to be opposite to the drive roller 142. The secondary transfer roller 145 is in pressure contact with the outer surface of the intermediate transfer belt 141, and a transfer nit part is formed between the secondary transfer roller 145 and the drive roller 142. The toner image primarily transferred onto the intermediate transfer belt 141 is secondarily transferred onto the sheet P, fed from the sheet feed section 12, in a transfer nip part. That is, the intermediate transfer unit 14 and the secondary transfer roller 145 transfer the toner image borne by each photosensitive drum 20 onto the sheet P. A roller cleaner 200 for cleaning a circumferential surface of the drive roller 142 is located adjacent to the drive roller 142.

The toner replenishment section 15 stores the toner to be used for image formation. In the present embodiment, the toner replenishment section 15 includes a magenta toner container 15M, a cyan toner container 15C, a yellow toner container 15Y, and a black toner container 15Bk. The toner containers 15M, 15C, 15Y, and 15Bk respectively store M, C, Y and Bk toners for replenishment. The toners of these colors are supplied from toner exit ports 15H formed in bottom surfaces of the containers to the respective image forming units 13M, 13C, 13Y, or 13Bk corresponding to the colors M, C, Y, and Bk.

The fixing section 16 includes a heating roller 161, a fixing roller 162, a fixing belt 163, and a pressure roller 164. The heating roller 161 accommodates a heat source therein. The fixing roller 162 is located opposite to the heating roller 161. The fixing belt 163 is extended between the heating roller 161 and the heating roller 161. The pressure roller 164 is located opposite to the fixing roller 162 with the fixing belt 163 therebetween. A fixing nip part is formed between the pressure roller 164 and the fixing roller 162. The sheet P supplied to the fixing section 16 passes the fixing nip part to be heated and pressurized. As a result, the toner image transferred onto the sheet P in the transfer nip part is fixed onto the sheet P.

The ejection section 17 is formed as a result of a top part of the main body 11 being recessed. The ejection section 17 includes an exit tray 171 formed at a bottom surface of the recessed portion. The exit tray 171 receives the sheet P when the sheet P is ejected. The sheet P subjected to the fixing process is ejected toward the exit tray 171 via the sheet conveyance path 111 extended from an area above the fixing section 16.

<Developing Device>

Figure 2:
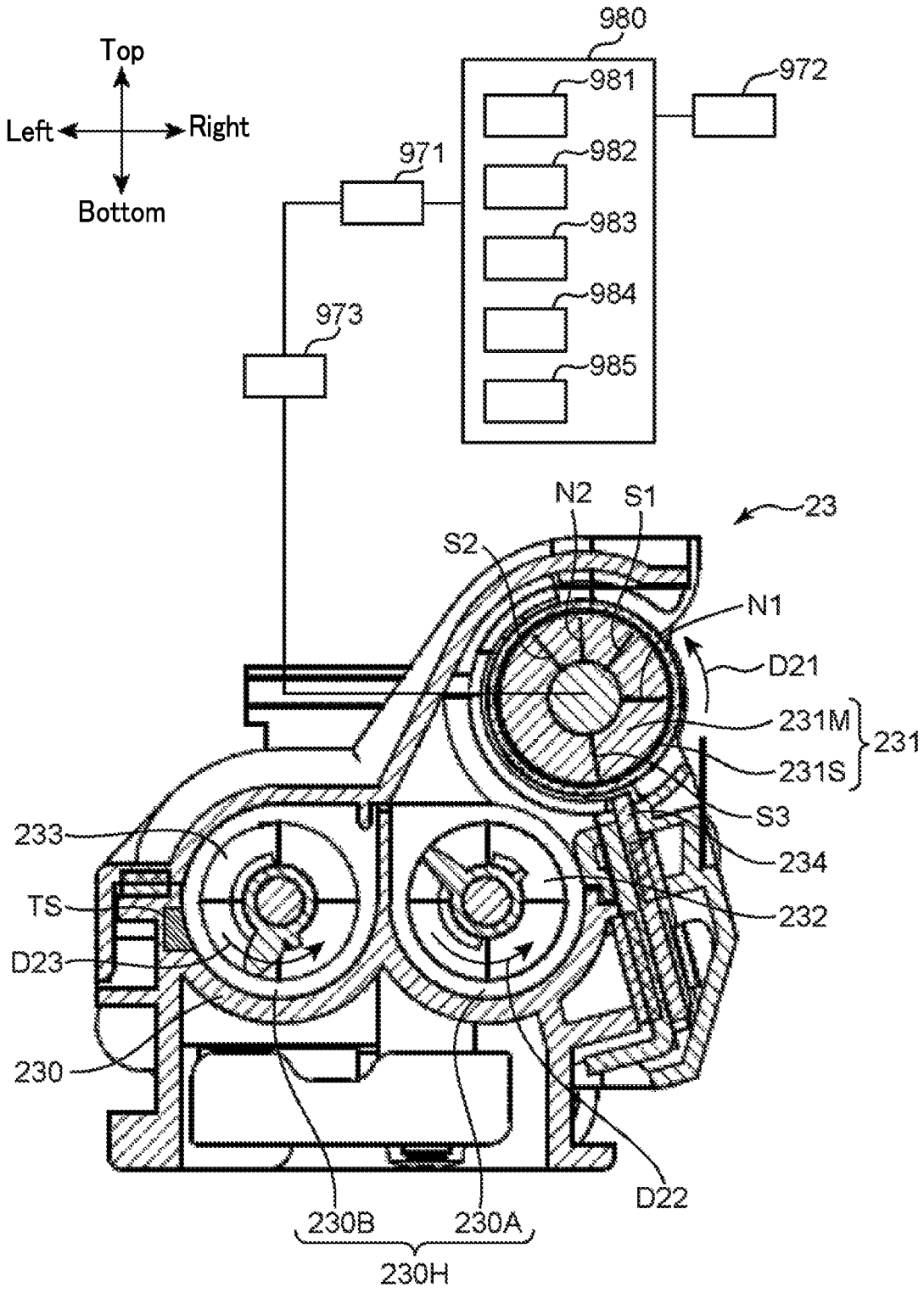
FIG. 2 provides a cross-sectional view of a developing device according to an embodiment of the present disclosure and a block diagram illustrating an electric configuration of a controller according to an embodiment of the present disclosure.

FIG. 2 provides a cross-sectional view of the developing device 23 and a block diagram illustrating an electric configuration of a controller 980 according to the present embodiment. The developing device 23 includes a development housing 230, the developing roller 231, a first screw feeder 232, a second screw feeder 233, and a restricting blade 234. The developing device 23 adopts a two-component developing system.

The development housing 230 accommodates a developer accommodating section 230H. The developer accommodating section 230H accommodates a two-component developer containing a toner and a carrier. The developer accommodating section 230H includes a first conveyance section 230A and a second conveyance section 230B. The first conveyance section 230A conveys the developer in a first conveyance direction, which is from one end to the other end of the developing roller 231 in an axial direction thereof (the first conveyance direction is perpendicular to the drawing surface of FIG. 2, and extends from a rear side to a front side). The second conveyance section 230B is in communication with the first conveyance section 230A at both of the two ends in the axial direction, and conveys the developer in a second conveyance direction opposite to the first conveyance direction. The first screw feeder 232 and the second screw feeder 233 respectively rotate in directions indicated by arrows D22 and D23 in FIG. 2. The first screw feeder 232 and the second screw feeder 233 convey the developer respectively in the first conveyance direction and the second conveyance direction. In particular, the first screw feeder 232 supplies the developer to the developing roller 231 while conveying the developer in the first conveyance direction.

Figure 3A:
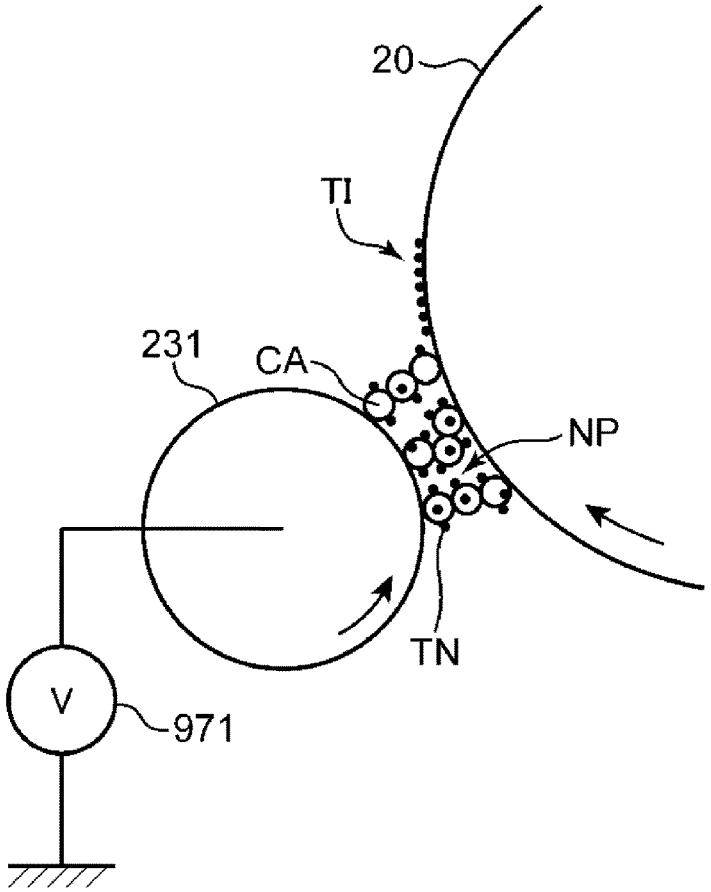
FIG. 3A is a schematic view illustrating a development operation of the image forming apparatus according to an embodiment of the present disclosure.

The developing roller 231 is located opposite to the photosensitive drum 20 in the developing nip part NP (FIG. 3A). The developing roller 231 includes a rotatable sleeve 231S and a magnet 231M securely located in the sleeve 231S. The magnet 231M includes an S1 pole, an N1 pole, an S2 pole, an N2 pole, and an S3 pole. The N1 pole mainly acts as a main pole, the S1 pole and the N2 pole each act as a conveyance pole, and the S2 pole acts as a peeling pole. The S3 pole acts as a pump-up pole and a restricting pole. In an example, the S1 pole, the N1 pole, the S2 pole, the N2 pole, and the S3 pole are respectively set to have magnetic flux densities of 54 mT, 96 mT, 35 mT, 44 mT, and 45 mT. The sleeve 231S of the developing roller 231 is rotated in a direction indicated by an arrow D21 in FIG. 2. While being rotated, the developing roller 231 receives the developer in the development housing 230, bears a developer image, and supplies the toner to the photosensitive drum 20. In the present embodiment, the developing rollers 231 are rotated in the same direction (width direction) as each other at positions opposite to the photosensitive drums 20.

The restricting blade 234 (layer thickness restricting member) is located away from the developing roller 231 by a predetermined distance, and restricts the thickness of the layer of the developer supplied onto the circumferential surface of the developing roller 231 from the first screw feeder 232.

The image forming apparatus 10 including the developing device 23 further includes a developing bias applying section 971, a driving section 972, an ammeter 973 (developing current measuring section), and the controller 980. The controller 980 includes a central processing unit (CPU), read-only memory (ROM) storing a control program therein, random-access memory (RAM) used as a working area of the CPU, and the like.

The developing bias applying section 971 includes a DC power source and an AC power source. Based on a control signal from a bias controller 982 (described later), the developing bias applying section 971 applies, to the developing roller 231, a developing bias including an AC voltage superposed on a DC voltage.

The driving section 972 includes a motor and a gear mechanism conveying a torque of the motor. When an image formation operation and a charge amount measuring mode are to be executed, the driving section 972 drives and rotates the developing roller 231, the first screw feeder 232, and the second screw feeder 233 in the developing device 23, as well as the photosensitive drums 20 and the like, according to a control signal from a driving controller 981 (described later). The driving section 972 further generates a driving force to drive (rotate) other elements of the image forming apparatus 10. The "image formation operation" refers to an operation of driving the photosensitive drum 20, the charger 21, the exposure device 22, the developing device 23, the primary transfer roller 24, the intermediate transfer unit 14, the secondary transfer roller 145, and the fixing section 16 to form an image on the sheet P.

The ammeter 973 measures a DC component of an electric current flowing between the developing roller 231 and the developing bias applying section 971 (hereinafter, such an electric current will be referred to as a "developing current").

As a result of the CPU executing the control program stored on the ROM, the controller 980 acts so as to include the driving controller 981, the bias controller 982, a storage 983, a mode controller 984, and a determining section 985. The mode controller 984 is an example of each of "charge amount acquiring section", "characteristic value outputting section", and "lifetime predicting section". The determining section 985 is an example of "execution timing determining section".

The driving controller 981 controls the driving section 972 to drive and rotate the developing roller 231, the first screw feeder 232, and the second screw feeder 233.

The driving controller 981 controls a driving mechanism (not illustrated) to drive and rotate the photosensitive drum 20.

When a development operation of forming the toner image on the photosensitive drum 20 is to be executed, the bias controller 982 controls the developing bias applying section 971 to provide a potential difference in the DC voltage and a potential difference in the AC voltage between the photosensitive drum 20 and the developing roller 231. The toner is moved from the developing roller 231 to the photosensitive drum 20 due to the potential differences, and as a result, the toner image is formed on the photosensitive drum 20.

The storage 983 stores thereon various information referred to by the driving controller 981, the bias controller 982, the mode controller 984, and the determining section 985. For example, the storage 983 stores thereon a developing bias value that is adjustable according to the rotation rate of the developing roller 231 or the environment. The storage 983 also stores a charge amount of the toner (hereinafter, may be referred to as a "toner charge amount") acquired by the mode controller 984 each time the toner charge amount is acquired.

The storage 983 has reference information for each of the toner charge amounts stored thereon in advance. The "reference information" is the following. It is now assumed that in the state in which the potential difference in the DC voltage between the developing roller 231 and the photosensitive drum 20 is kept constant and the frequency of the AC voltage of the developing bias is changed. The "reference information" is information on the gradient of a reference straight line that represents the relationship of a change amount in the density of the toner image with respect to a change amount in the frequency. The reference information stored on the storage 983 indicates that in the case where the toner charge amount is a first virtual charge amount, the gradient of the reference straight line is negative. The reference information stored on the storage 983 also indicates that in the case where the toner charge amount is a second virtual charge amount smaller than the first virtual charge amount, the gradient of the reference straight line is positive. The reference information is set such that as the toner charge amount is decreased, the gradient of the reference straight line is increased.

The storage 983 stores a characteristic value (described later) output by the mode controller 984 each time the characteristic value is output. The storage 983 stores the toner charge amount acquired by the mode controller 984 each time the toner charge amount is acquired. The storage 983 may store thereon in advance an initial value and threshold value of a characteristic value threshold value change information (described later). The information stored on the storage 983 may be in the form of a graph, a table, or the like.

During a non-development operation time period, the mode controller 984 executes the charge amount measuring mode at a predetermined execution timing. The non-development operation time period is different from a development operation time period, in which a visually recognizable toner image, of an image, to be transferred onto the sheet P is formed on the photosensitive drum 20. The "execution timing" encompasses a timing when an instruction to execute the charge amount measuring mode is input via the operation panel, a timing when a degraded toner ejection control of ejecting degraded toner from the developing roller 231 toward the photosensitive drum 20 (control of developing an electrostatic latent image with the degraded toner) is started, and an execution timing determined by the determining section 985. The charge amount measuring mode is an example of "charge amount acquisition operation".

In the charge amount measuring mode, the mode controller 984 controls the charger 21, the exposure device 22, the developing bias applying section 971, and the like to form a plurality of toner images for measurement (hereinafter, referred to as "measurement toner images") developed with different amounts of toner on the photosensitive drum 20. The mode controller 984 acquires the charge amount of toner contained in each of the measurement toner images formed on the photosensitive drum 20 based on the density of each of the plurality of measurement toner images detected by the density sensor 100, or based on the density of each of the plurality of measurement toner images and the DC component of the developing current flowing between the developing roller 231 and the developing bias applying section 971 when the plurality of measurement toner images are to be formed.

This will be described in more detail. In the charge amount measuring mode, the mode controller 984 forms the plurality of measurement toner images on the photosensitive drum 20 while changing the frequency of the AC voltage of the developing bias in the state in which the potential difference in the DC voltage between the developing roller 231 and the photosensitive drum 20 is kept constant. The mode controller 984 acquires the gradient of the measurement straight line that represents the relationship of the density change amount in each of the measurement toner images with respect to the change amount in the frequency, based on the change amount in the frequency and results of detection on the density of the measurement toner images by the density sensor 100. The mode controller 984 also acquires the charge amount of the toner contained in each of the measurement toner images formed on the photosensitive drums 20, based on the acquired gradient of the measurement straight line and the reference information stored on the storage 983.

The mode controller 984 acquires the DC component of the developing current measured by the ammeter 973 at a predetermined measurement timing, and outputs the characteristic value according to the DC component of the developing current. In the present embodiment, the mode controller 984 outputs, as the characteristic value, the DC component of the developing current measured by the ammeter 973.

The "measurement timing" is defined as the timing when a non-image forming region of the surface of the photosensitive drum 20 faces the developing roller 231 in the entirety of a rotation axis direction of the photosensitive drum 20, and an electric field, in a direction in which the toner moves from the photosensitive drum 20 toward the developing roller 231 by the potential difference between the surface potential of the photosensitive drum 20 and the DC component of the developing bias, is formed in the developing nip part NP (FIG. 3A). The "non-image forming region" refers to a region that is on the surface of the photosensitive drum 20 and is different from an image forming region where a visually recognizable toner image of an image to be transferred onto the sheet P is formed.

At the measurement timing, it is difficult that the value of the developing current measured by the ammeter 973 includes a current component flowing when the toner moves from the developing roller 231 toward the photosensitive drum 20. That is, at the measurement timing, the mode controller 984 acquires the DC component of the developing current measured by the ammeter 973, and thus acquires the value of the current flowing in the carrier (hereinafter, referred to as a "carrier current") with high precision.

The mode controller 984 also predicts the time when the lifetime of the developer in the developing device 23 is over (hereinafter, such time will be referred to as "time of finish of lifetime"), based on a transition of the characteristic value stored on the storage 983. The mode controller 984 outputs lifetime information on the predicted time of finish of lifetime.

The determining section 985 determines the execution timing for the charge amount measuring mode according to the characteristic value output by the mode controller 984. The determining section 985 causes the mode controller 984 to execute the charge amount measuring mode each time the determined execution timing arrives.

<Development Operation>

Figure 3B:
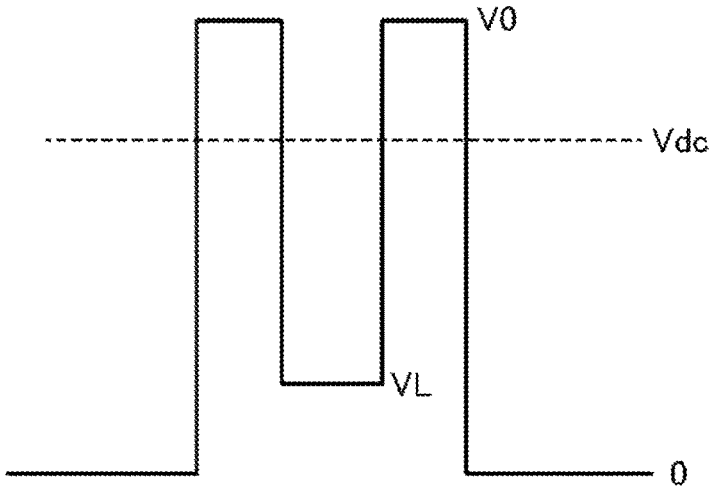
FIG. 3B is a schematic view provided to compare the potential levels of an image bearing member and a developing roller according to an embodiment of the present disclosure.

FIG. 3A is a schematic view of a development operation of the image forming apparatus 10 according to the present embodiment. FIG. 3B is a schematic view provided to compare the potential levels of the photosensitive drum 20 and the developing roller 231. As illustrated in FIG. 3A, the developing nip part NP is formed between the developing roller 231 and the photosensitive drum 20. Toner particles TN and carrier particles CA borne on the developing roller 231 form a magnetic brush. In the developing nip part NP, the toner particles TN are supplied from the magnetic brush toward the photosensitive drum 20, and thus a toner image TI is formed. As illustrated in FIG. 3B, the surface of the photosensitive drum 20 is charged to a background region potential V0 (V) by the charger 21. After this, when the exposure device 22 directs exposure light, the surface potential of the photosensitive drum 20 changes from the background region potential V0 to an image region potential VL (V) at the maximum according to the image to be printed. In the meantime, the developing roller 231 is supplied with a DC voltage Vdc of the developing bias, and an AC voltage (not illustrated) is superposed on the DC voltage Vdc.

In the case of such a reversal development system, the potential difference between the surface potential V0 and the DC component Vdc of the developing bias is the potential difference that results in inhibition of the toner fogging on a background region of the photosensitive drum 20. In the meantime, the potential difference between the post-exposure surface potential VL and the DC component Vdc of the developing bias is the developing potential difference that causes movement of the toner having a positive polarity to an image region of the photosensitive drum 20. In addition, the AC voltage applied to the developing roller 231 promotes movement of the toner from the developing roller 231 to the photosensitive drum 20.

The toner particles TN are each charged by friction with the carrier particles CA while being circulated and conveyed in the development housing 230. The charge amount of each toner particle TN influences the amount of the toner moving toward the photosensitive drum 20 by the developing bias (i.e., influences the amount of the toner sued for the development). Therefore, once it is made possible to predict, with high precision, the charge amount of the toner particles TN in the image forming apparatus 10, a high image quality may be maintained by adjusting the developing bias or the toner density according to the number of sheets on which image formation has been made, the environmental changes, the image formation mode, the coverage rate, and the like. For this reason, technologies that predict the toner charge amount with high precision have been proposed conventionally.

For example, according to one proposed technology, the surface potential of the pre-development photosensitive drum 20 and the surface potential of the toner layer on the post-development photosensitive drum 20 are measured. Separately, based on results of measurement on the image density of the toner layer formed as a result of the development, the amount of the toner used for the development is calculated. Based on the measured surface potentials and the amount of the toner used for the development, the toner charge amount is calculated (hereinafter, referred to as a "first conventional technology"). According to another proposed technology, a value of a current flowing into the developing roller 231 that bears the developer is assumed to be an amount of electric charge of the toner moved from the developing roller 231 to the photosensitive drum 20. Based on the results of measurement on the image density of the toner layer formed as a result of the development, the amount of the toner used for the development is calculated. Based on the amount of electric charge of the toner and the amount of the toner used for the development, the toner charge amount is calculated (hereinafter, referred to as a "second conventional technology").

<Problems of Conventional Technologies>

According to the first conventional technology, a surface potential sensor is needed in order to measure the surface potential of the photosensitive drum 20. In order to measure the surface potential of the toner layer formed on the photosensitive drum 20, the surface potential sensor needs to be set downstream, in the rotation direction of the photosensitive drum 20, with respect to the developing nip part NP (FIG. 3A). However, if the surface potential sensor is set at such a position, a surface of the surface potential sensor is easily contaminated with toner scattered from the developing roller 231. This makes it difficult to measure the surface potential with high precision for a long period of time.

According to the second conventional technology, the current flowing into the developing roller 231 includes a current flowing in the carrier in addition to the current flowing in the toner. Therefore, it is difficult to calculate the toner charge amount with high precision based on the value measured by the ammeter 973. In addition, when a resistance value of the carrier is changed by the coating of the carrier being peeled off or by the coating being contaminated as a result of repetitive printing by the image forming apparatus 10, the value of the current flowing in the carrier is also changed. As such, it is difficult with the conventional technologies to measure the amount of electric charge of the toner accurately based on the current flowing into the developing roller 231.

According to each of the first conventional technology and the second conventional technology, an image pattern including measurement toner images is formed on the photosensitive drum 20 in order to measure the toner charge amount. In order to measure the toner charge amount with high precision, it is desirable to form the measurement toner images frequently. In this case, however, the time period in which the usual image formation operation cannot be performed is extended, and the amount of the toner consumed for the measurement is increased. Therefore, it is desirable to efficiently determine the timing to measure the toner charge amount.

<Prediction of Toner Charge Amount>

The present inventor kept on making active studies under the above-described situation, and as a result, newly obtained knowledge that in the case where the frequency of the AC voltage of the developing bias is changed, the change in the amount of toner used for the development varies according to the toner charge amount. Specifically, in the case where the toner charge amount is small, the amount of toner used for the development increases as the frequency of the AC voltage is increased. By contrast, in the case where the toner charge amount is large, the amount of toner used for the development decreases as the frequency of the AC voltage is increased. It is made possible to, by use of such a characteristic, predict the toner charge amount with high precision by measuring the change in the image density when the frequency of the AC voltage is changed.

Figure 4:
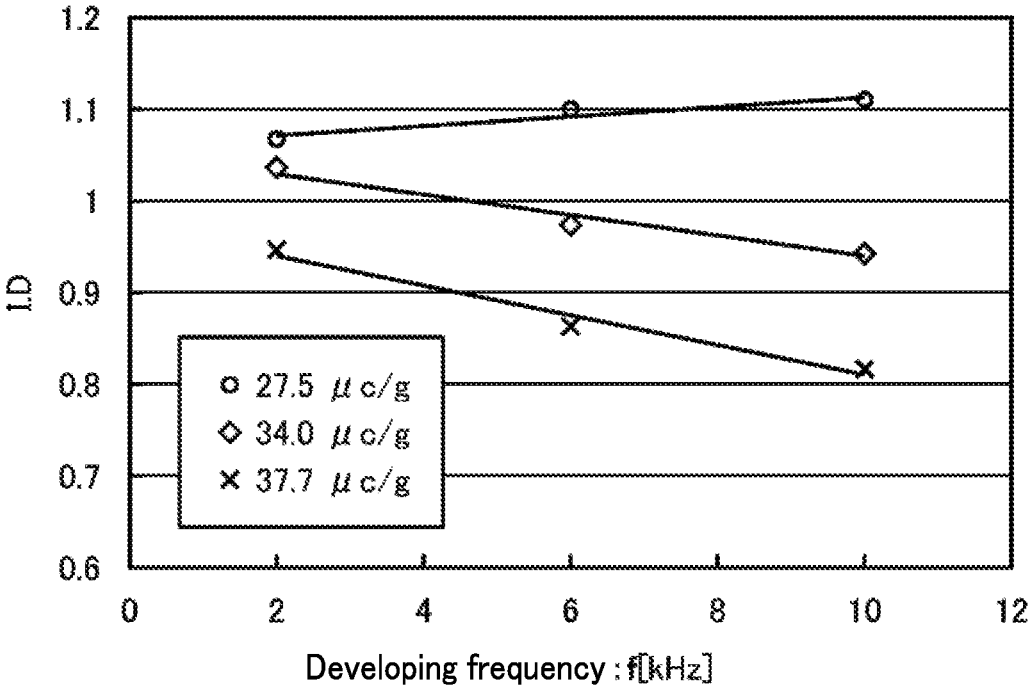
FIG. 4 is a graph showing the relationship between the frequency of a developing bias and the image density in the image forming apparatus according to an embodiment of the present disclosure.
Figure 5:
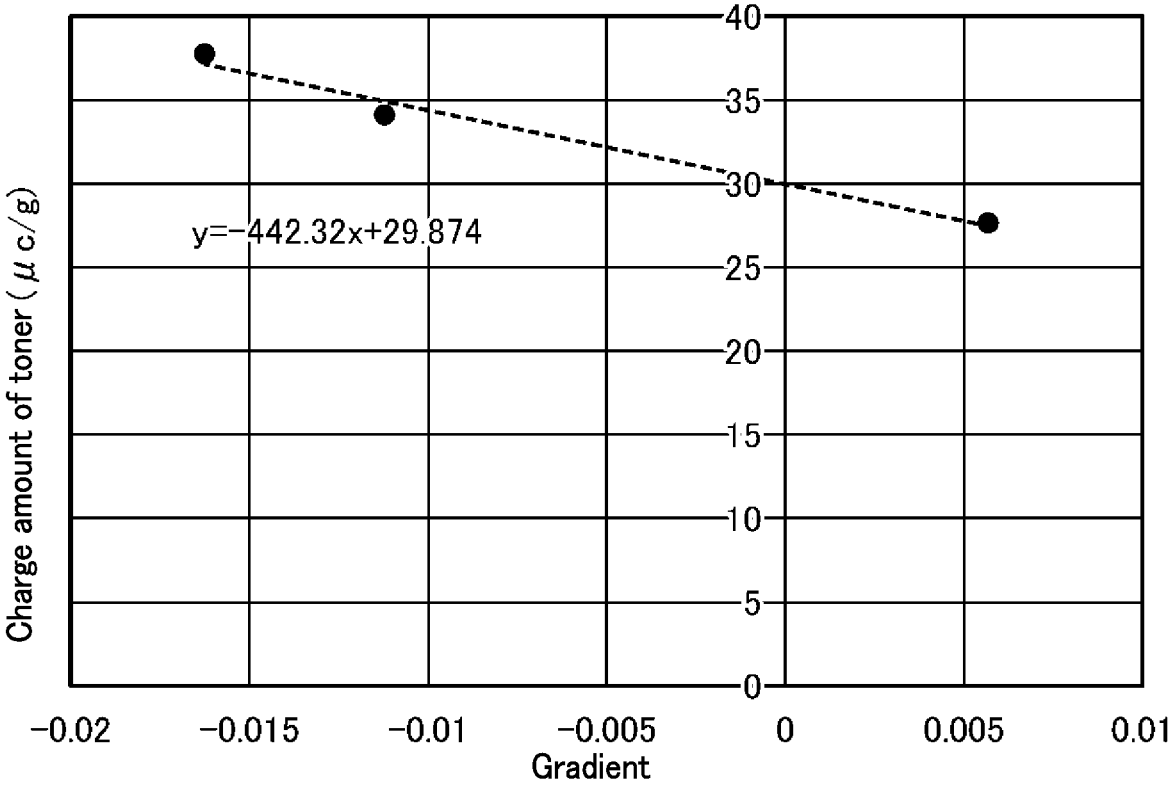
FIG. 5 is a graph showing the relationship between the gradients of the lines in FIG. 4 and the charge amount of the toner in the image forming apparatus according to an embodiment of the present disclosure.

FIG. 4 is a graph showing the relationship between the frequency of the developing bias and the image density in the image forming apparatus 10 according to the present embodiment. FIG. 5 is a graph showing the relationship between the gradients of the lines in FIG. 4 and the toner charge amount in the image forming apparatus 10 according to the present embodiment.

While the potential difference between the DC voltage of the developing bias applied to the developing roller 231 and the DC voltage of the electrostatic latent image on the photosensitive drum 20 is kept constant, the frequency of the AC voltage of the developing bias is changed in the state in which the peak-to-peak voltage Vpp of the AC voltage of the developing bias and the duty ratio are fixed. As a result, a tendency is exhibited that the image density of the toner image detected by the density sensor 100 varies according to the toner charge amount on the developing roller 231 (FIG. 4). That is, as shown in FIG. 4, in the case where the toner charge amount is 27.5 μc/g, the image density decreases as the frequency f is decreased. By contrast, in the case where the toner charge amount is 34.0 μc/g and 37.7 μc/g, the image density increases as the frequency f is decreased. As the toner charge amount is decreased, the gradients of the lines shown in FIG. 4 increases. As can be seen from FIG. 5, the relationship between the gradients of the three lines in FIG. 4 and the corresponding toner charge amounts is distributed on a straight line (approximation straight line). Therefore, provided that the information shown in FIG. 5 is stored on the storage 983 in advance and the gradients of the lines shown in FIG. Namely 4 are derived in the charge amount measuring mode (described later), it is made possible to measure (predict) the toner charge amount at the corresponding timing.

<Effects Provided by Prediction of Toner Charge Amount>

In the present embodiment, the following effects are further provided by predicting the toner charge amount. It is not necessary to provide a surface potential sensor that measures the surface potential of the photosensitive drum 20 in order to predict the toner charge amount. It is not necessary to measure the value of the current flowing into the developing roller 231 according to the developing bias in order to predict the toner charge amount. Therefore, it is made possible to predict the toner charge amount stably with no influence of the contamination of the surface potential sensor or a change in the value of the current flowing into the developing roller 231 occurring due to a change in the resistance of the carrier. In the case where the density of the image formed by the image forming apparatus 10 is decreased, this makes it easy to choose whether to increase the toner density of the developing device 23 to decrease the toner charge amount to increase the image density, or to increase the developing potential difference (Vdc−VL) in the developing nip part NP to increase the image density.

In general, the image density is considered to be decreased in the image forming apparatus 10 due to at least one of "decrease in the developing potential difference", "decrease in the conveyance amount of the developer passing the restricting blade 234", "increased in the resistance of the carrier", "increase of the toner charge amount", and the like. It is now assumed that the image density is decreased by a reason other than the "increase in the toner charge amount". In this case, if the toner density is increased in order to decrease the toner charge amount, another inconvenience such as toner scattering may undesirably occur. In the case where the image density is decreased by the increase in the toner charge amount, it is desirable to increase the toner density to decrease the toner charge amount. In the case where the image density is decreased by any other reason, it is preferred to increase the developing electric field (developing bias). Grasping the toner charge amount allows the transfer current supplied to the secondary transfer roller 145 to be optimized. This further stabilizes the entire system of the image forming apparatus 10.

<Relationship Between Frequency and Toner Charge Amount>

The present inventor presumes that when the frequency of the AC voltage of the developing bias is changed, the toner charge amount contributes to a change in the image density in the following manner.

(1) Where Toner Charge Amount is Small

In the case where the toner charge amount is small, the electrostatic force acting between the toner and the carrier is small. Therefore, the toner is easily separated from the carrier. However, when the frequency of the AC voltage of the developing bias is decreased, the number of times the toner moves back and forth in the developing nip part NP decreases. This decreases the image density. When the frequency is decreased, the distance by which the toner moves back and forth per cycle of the AC voltage extends. However, in the case where the toner charge amount is small, the moving distance of the toner is basically short, and therefore, the influence on the decrease in the image density is small. As such, in the case where the toner charge amount is small, when the frequency of the AC voltage of the developing bias is decreased, the image density decreases.

(2) Where Toner Charge Amount is Large

As described above, when the frequency of the AC voltage of the developing bias is decreased, the number of times the toner moves back and forth in the developing nip part NP decreases. However, in the case where the toner charge amount is large, the toner is not easily separated from the carrier basically. Therefore, the influence of the decrease in the number of times the toner moves back and forth is small. In the meantime, when the frequency is decreased, the distance by which the toner moves back and forth per cycle of the AC voltage extends. Therefore, the image density is increased according to the large toner charge amount. As such, in the case where the toner charge amount is large, when the frequency of the AC voltage of the developing bias is decreased, the image density increases.

<Flow of Toner Charge Amount Measuring Mode>

Figure 6:
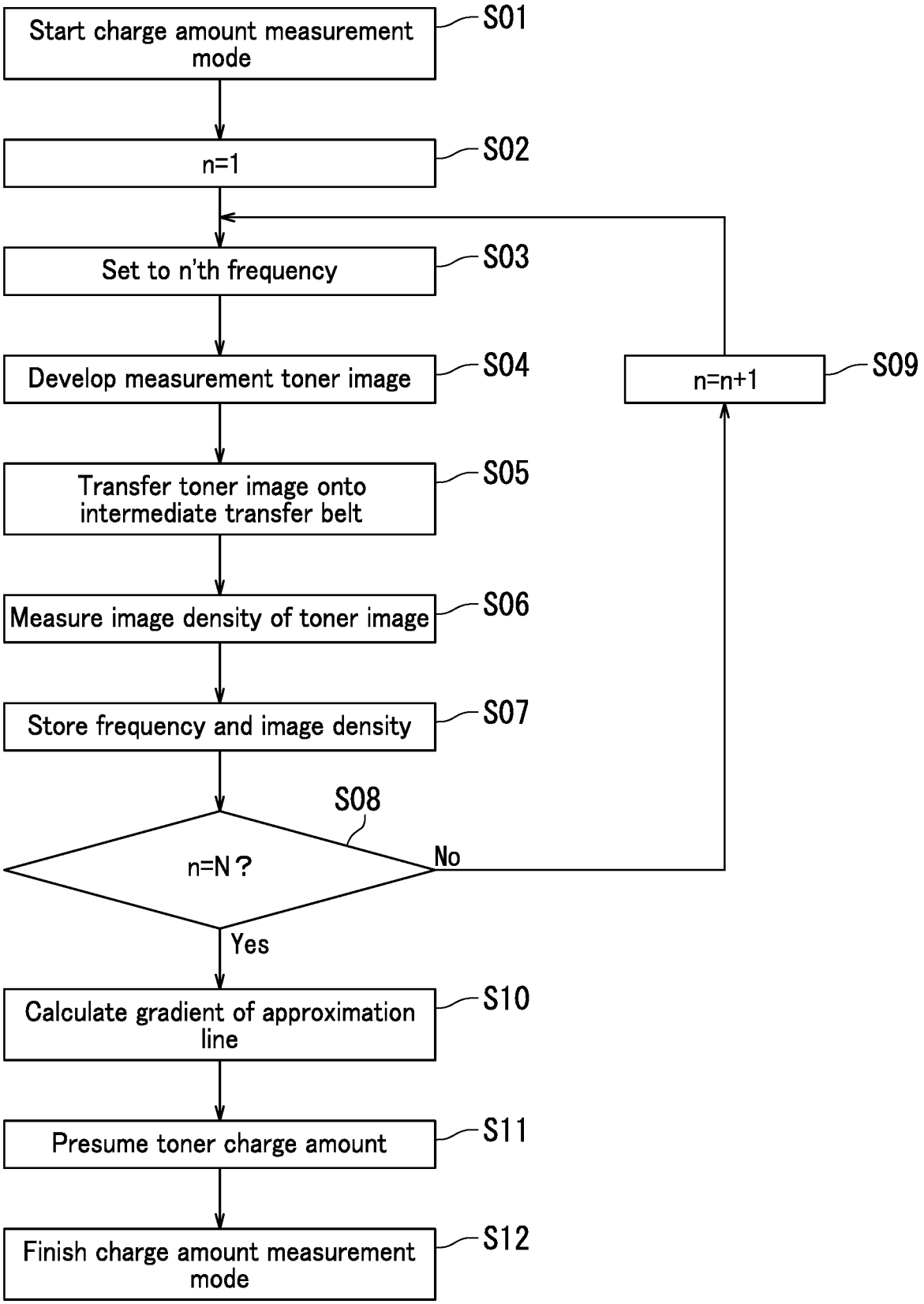
FIG. 6 is a flowchart of a charge amount measurement mode executed by the image forming apparatus according to an embodiment of the present disclosure.
Figure 7:
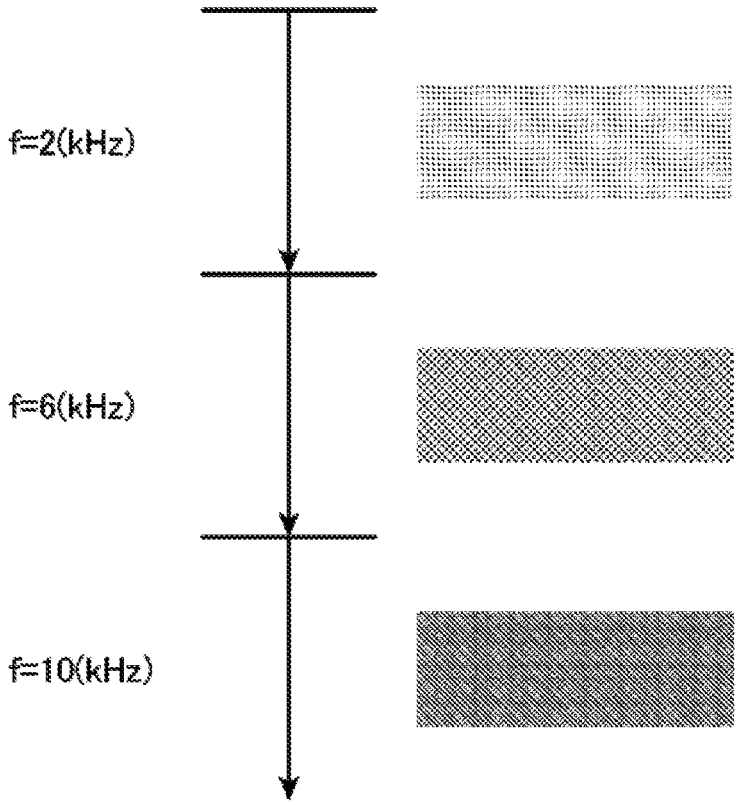
FIG. 7 is a schematic view of measurement toner images formed on the image bearing member during the charge amount measurement mode executed by the image forming apparatus according to an embodiment of the present disclosure.

FIG. 6 is a flowchart of the charge amount measuring mode executed by the image forming apparatus 10 according to the present embodiment. FIG. 7 is a schematic view of measurement toner images formed on the photosensitive drum 20 in the toner charge amount measuring mode.

As illustrated in FIG. 6, when the charge amount measuring mode is started (Step S01), the mode controller 984 sets a variable n to be used to change the frequency of the AC voltage of the developing bias to n=1 (Step S02). The mode controller 984 controls the driving controller 981 and the bias controller 982 to rotate the developing roller 231 by one or more rotations in the state in which a preset reference developing bias is applied to the developing roller 231, and then sets the frequency of the AC voltage of the developing bias to a first frequency (n=1) (Step S03).

The reference developing bias is set in order to prevent the charge amount measuring mode from being influenced by the history of the immediately previous cycle of image formation. Usually, a bias to be used for printing (image formation) is used as the reference developing bias. It is desirable to apply a DC voltage and an AC voltage in a superposing manner as the reference developing bias because in the case where only a DC voltage is used as the reference developing bias, the effect of avoiding the influence of the history is weak.

Next, the preset measurement toner images are developed with the developing bias for which the frequency of the AC voltage is set to the first frequency (Step S04). Next, the toner images are transferred from the photosensitive drums 20 onto the intermediate transfer belt 141 (Step S05). The image densities of the measurement toner images are measured by the density sensor 100 (Step S06). The acquired image densities are stored on the storage 983 together with the value of the first frequency (Step S07).

Next, the mode controller 984 determines whether or not the variable n for the frequency has reached a preset specified number of times N (Step S08). In the case where n≠N (No in Step S08), the value of n is counted up by one (n=n+1; Step S09). The processes of Steps S03 through S07 are repeated. In order to increase the precision of the charge amount measurement, the specified number of times N is desirably 2≤N, and is more desirably 3≤N. By contrast, in the case where n=N (Yes in Step S08), the mode controller 984 calculates the gradient of the approximation straight line shown in FIG. 4 based on the information stored on the storage 983 (Step S10). The mode controller 984 estimates the toner charge amount from the gradient based on the line (reference information) shown in FIG. 5 stored on the storage 983 (Step S11). Thus, the charge amount measurement mode is finished (Step S12).

FIG. 7 shows an example in which when the specified number N=3, the image densities of the measurement toner images are increased by increasing the frequency f. In this case, the toner charge amount is relatively low, for example, 27.5 μc/g, as shown in FIG. 4

In the case where N=2, the respective image densities measured in Step S06 are defined as ID1 and ID2. The first frequency is defined as f1 (kHz), and a second frequency is defined as f2 (kHz) (f2<f1). In this case, gradient "a" of each of the straight lines illustrated in FIG. 4 is calculated by expression 1.

$$\text{Gradient } a=(\text{ID1}-\text{ID2})/(f1-f2) \qquad \text{expression 1}$$

Gradient "a" varies according to the toner charge amount. In the case where the toner charge amount is small, the gradient "a" has a positive value, whereas in the case where the toner charge amount is large, the gradient "a" has a negative value. In the case where the measurement is performed under the condition of 3≤N, the gradient of the approximation straight line of the primary expression found by the least squares method may be used.

The reference information illustrated in FIG. 5 is represented by expression 2.

$$Q/M=A\times\text{gradient of the line}\times B \qquad \text{expression 2}$$

In expression 2, A and B represent values inherent to the developer and are pre-determined by experiments. Q/M represents the toner charge amount per unit mass. The toner charge amount Q/M is calculated by substituting the gradient "a" of the approximation straight line found from expression 1 in Step S10 into expression 2.

The charge amount measurement mode illustrated in FIG. 6 may be executed for the developing device 23 of each of the colors illustrated in FIG. 1. The frequency set during the execution of the mode may be set to a value inherent to each developing device 23. Especially in the case where a frequency desirable for the temperature and the humidity around the image forming apparatus 10 or for the cumulative number of sheets of image formation is known, the frequency set during the execution of the mode may be a frequency close to the known frequency. Alternatively, a frequency to be used for a measurement mode to be newly executed may be selected with reference to results of the immediately previous cycle of charge amount measurement mode. In this case, the precision of the measurement on the toner charge amount may be improved.

<Execution Timing for Charge Amount Measurement Mode>

The charge amount measurement mode according to the present embodiment is manually started in response to an instruction input by use of the operation panel. Alternatively, the charge amount measurement mode according to the present embodiment is automatically started at an execution timing. The execution timing is determined by a timing at which a degraded toner ejection control of ejecting the degraded toner from the developing roller 231 toward the photosensitive drum 20 (control of developing an electrostatic latent image with the degraded toner) is started and by the determining section 985.

In the case where the charge amount measurement mode as illustrated in FIG. 6 is to be executed, an image pattern including measurement toner images is formed on the photosensitive drum 20. In order to measure the toner charge amount with high precision, it is desirable to form the measurement toner images frequently. In this case, however, the time period in which the usual image formation operation cannot be performed is extended, and the amount of the toner consumed for the measurement is increased. Therefore, it is important to efficiently determine the timing to measure the toner charge amount. In the present embodiment, in order to solve these problems, the determining section 985 efficiently determines an execution timing for the charge amount measurement mode.

It is desirable that the above-described charge amount measurement mode is executed when the image forming apparatus 10 is shipped from the plant after being produced and also when the image forming apparatus 10 is set up at a location of use thereof. In the case where the charge amount measurement mode is executed at such timings, it is made possible to predict the influence of the time period in which the image forming apparatus 10 is at a pause. This will be described more specifically. In the case where the time period in which the image forming apparatus 10 is at a pause is long, the charge amount of the developer tends to decrease. The level of this tendency often varies according to the time period for or the environment in which the image forming apparatus 10 is left uncared. Therefore, the degradation state of the developer caused by the image forming apparatus 10 being left uncared is predicted by measuring the toner charge amount at the time of shipment and at the time of setup. In the case where the time period in which the image forming apparatus 10 is left uncared is extremely long, or in the case where the image forming apparatus 10 is left uncared in a very bad environment, the difference between the toner charge amounts (the toner charge amount at the time of shipment and the toner charge amount at the time of setup) is detected as being large. In such a case, the developer may be urged to be replaced at the location of use.

In the case where the toner charge amounts at the time of shipment and at the time of setup are small but the difference between the toner charge amounts is small, the possibility that the developer degrades is low. Therefore, it is not necessary to replace the developer at the location of use, and the image quality may be improved by adjusting the toner density or the developing conditions (developing bias or the like). As described above, the toner charge amount measurement mode according to the present embodiment may be executed after the image forming apparatus 10 is left for a predetermined time period without being used, so that it is made possible to grasp a change in the state of the developer.

It is more desirable that a plurality of the density sensors 100 are arrayed in a main scanning direction (axial direction of the photosensitive drum 20) and that the measurement toner images are formed according to the positions of the density sensors 100 in the charge amount measurement mode. In the case where the measurement toner images are formed in correspondence with both of two ends of the photosensitive drum 20 in the axial direction, the toner charge amounts at both of two ends of the developing device 23 (developing roller 231) may be predicted. In the case where the difference between the toner charge amounts at the two ends is larger than a predetermined threshold value, there is a possibility that the charging performance in the developing device 23 is declined. Thus, the mode controller 984 urges the replacement of the developing device 23 or developer via, for example, a display (not illustrated) of the image forming apparatus 10.

As described above, in the charge amount measurement mode according to the present embodiment, the charge amount of the toner accommodated in the developing device 23 may be acquired with no use of the surface potential sensor for measuring the potential on the photosensitive drum 20 or the ammeter 973 for measuring the value of the developing current flowing into the developing roller 231. This makes it possible to determine, with high precision, whether or not the developer in the developing device 23 needs to be replaced or whether or not the developing bias needs to be adjusted.

In particular, the reference information stored on the storage 983 is set such that the reference straight line has a negative gradient in the case where the toner charge amount is a first virtual charge amount and such that the reference straight line has a positive gradient in the case where the toner charge amount is a second virtual charge amount smaller than the first virtual charge amount. The reference information stored on the storage 983 is further set such that the gradient of the reference straight line increases as the toner charge amount is decreased. Such a configuration allows the toner charge amount to be acquired with high precision based on the relationship between the frequency of the AC voltage of the developing bias and the density of the toner image (amount of the developing toner) formed on the photosensitive drum 20 (intermediate transfer belt 141).

<Flow of Operation of Determining Execution Timing for Charge Amount Measurement Mode>

Figure 8:
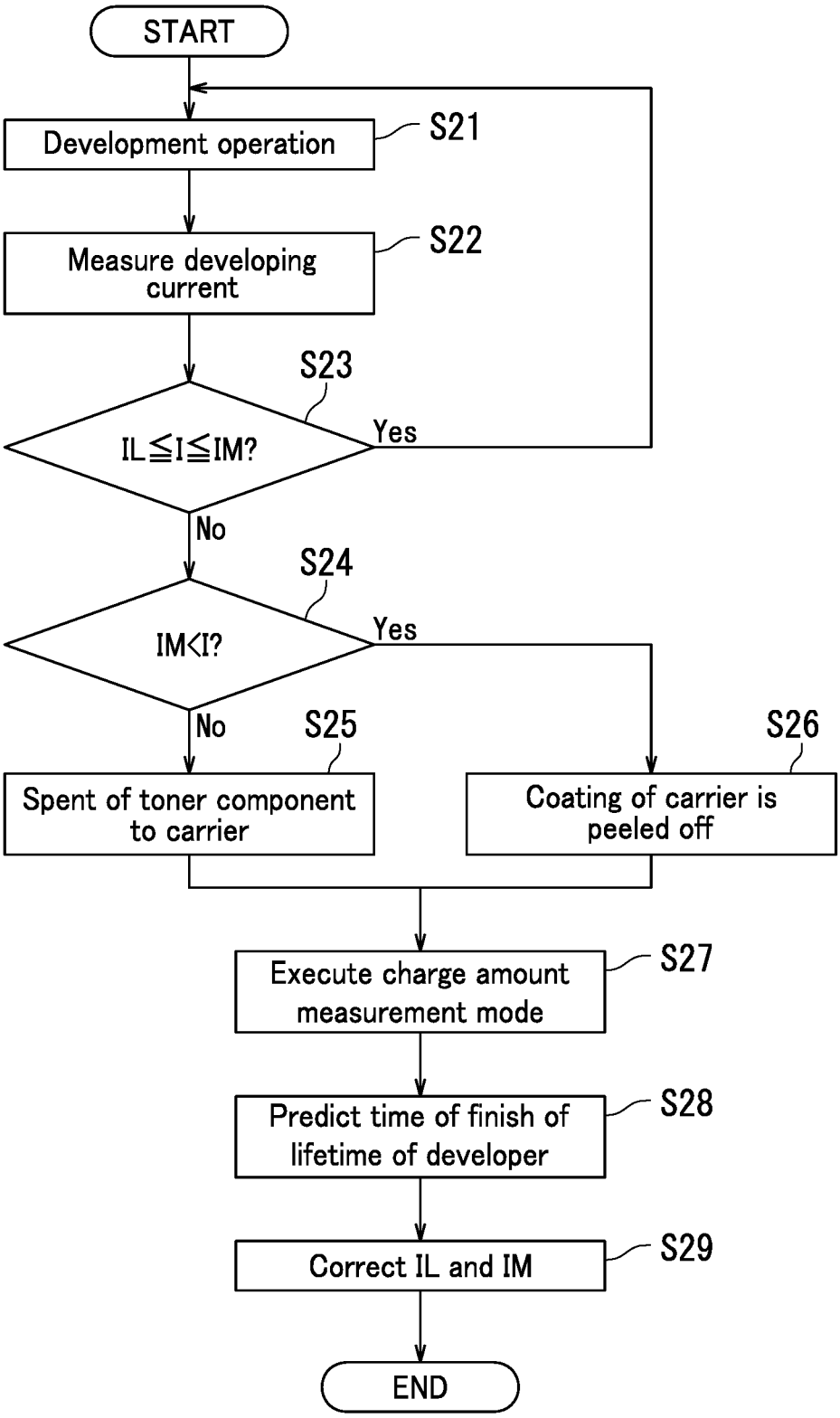
FIG. 8 is a flowchart illustrating an operation of determining an execution timing for the charge amount measurement mode executed by the image forming apparatus according to an embodiment of the present disclosure.

Now, an operation of determining the execution timing for the charge amount measurement mode will be described. FIG. 8 is a flowchart illustrating the operation of determining the execution timing for the charge amount measurement mode in the image forming apparatus 10 according to the present embodiment. As illustrated in FIG. 8, when the development operation is started in the image formation operation (Step S21), the mode controller 984 acquires the DC component of the developing current measured by the ammeter 973 at the measurement timing, and outputs the acquired DC component of the developing current as a characteristic value (Step S22). Each time the characteristic value is output in Step S22, the storage 983 stores the output characteristic value in correspondence with a cumulative number of the sheets P on which an image has been formed by the image forming apparatus when the process of Step S22 is executed (hereinafter, such a cumulative number will be referred to as a "cumulative number of sheets of image formation"). The value stored in correspondence with the characteristic value is not limited to the cumulative number of sheets of image formation, but may be a cumulative driving time period of the developing device 23 or the image forming apparatus 10, or a value obtained from a function (mathematical expression) using these values.

The determining section 985 determines whether or not a change amount between the characteristic value (first characteristic value) output by the mode controller 984 in the cycle of Step S22 executed before the latest cycle of Step S22 (output at a first measurement timing) and the characteristic value (second characteristic value) output by the mode controller 984 at the latest cycle of Step S22 (output at a second measurement timing) is larger than a preset characteristic value threshold value (Step S23).

Specifically, in Step S23, the determining section 985 determines whether or not expression 3 below is fulfilled. In expression 3, I represents the DC component of the developing current that is output as the characteristic value in the latest cycle of Step S22. IL represents a predetermined lower limit of the DC component of the developing current that is output as the characteristic value. IM represents a predetermined upper limit of the DC component of the developing current that is output as the characteristic value.

$$IL \leq I \leq IM \quad \text{expression 3}$$

The lower limit IL is defined as a value (=I0−TH) obtained by subtracting a characteristic value threshold value TH from a DC component I0 of the developing current that is output as the characteristic value in Step S22 executed during the development operation of developing the measurement toner images in the latest cycle of charge amount measurement mode (hereinafter, the above-described DC component I0 will be referred to as a "reference DC component I0). The upper limit IM is defined as a value (=I0+TH) obtained by adding the characteristic value threshold value TH to the reference DC component I0.

Therefore, as described later, expression 3 may be deformed to expression 4, expression 5, and expression 6 by use of a change amount |I−I0| of the DC component I of the developing current that is output as the characteristic value in the latest cycle of Step S22, with respect to the reference DC component I0 (hereinafter, the above-described change amount |I−I0| will be referred to as a "change amount ΔI).

$$I0-TH \leq I \leq I0+TH \quad \text{expression 4}$$

$$-TH \leq I-I0 \leq TH \quad \text{expression 5}$$

$$\Delta I \leq TH \quad \text{expression 6}$$

That is, the determining section 985 determines, in Step S23, whether or not expression 3 is fulfilled, and thus determines whether the change amount ΔI of the DC component I of the developing current that is output as the characteristic value in the latest cycle of Step S22, with respect to the reference DC component I0, is no larger than the characteristic value threshold value TH or larger than the characteristic value threshold value TH as represented by expression 6.

In the case where it is determined in Step S23 that expression 3 is fulfilled and thus the change amount ΔI is no larger than the characteristic value threshold value TH (Yes in Step S23), the fluctuation in the value of the carrier current from the time of execution of the latest cycle of charge amount measurement mode is small, and thus it is considered that the carrier has not been degraded much after the execution of the latest cycle of charge amount measurement mode. In this case (Yes in Step S23), the determining section 985 determines that it is not necessary to re-acquire the toner charge amount, and returns the procedure to Step S21.

In the case where it is determined in Step S23 that expression 3 is not fulfilled and thus the change amount ΔI is larger than the characteristic value threshold value TH (No in Step S23), the fluctuation in the value of the carrier current from the time of execution of the latest cycle of charge amount measurement mode is large, and thus it is considered that the degree of degradation of the carrier has been increased after the execution of the latest cycle of charge amount measurement mode. In this case (No in Step S23), the determining section 985 determines that it is necessary to re-acquire the toner charge amount, and determines that the execution timing for the charge amount measurement mode has arrived. In this case, the determining section 985 further determines a cause of the increase in the degree of degradation of the carrier.

Specifically, when a toner component is attached to the carrier and thus the carrier is degraded, the resistance value of the carrier is increased and the value of the carrier current is decreased. Therefore, in the case where the DC component I that is output as the characteristic value in Step S22 is smaller than the lower limit IL (IL>I) (No in Step S24), the determining section 985 determines that the degree of degradation of the carrier has been increased because of spent of the toner component to the carrier (Step S25).

When the coating of the carrier is peeled off and thus the carrier is degraded, the resistance value of the carrier is decreased and the value of the carrier current is increased. Therefore, in the case where the DC component I that is output as the characteristic value in Step S22 is larger than the upper limit IM (IM<I) (Yes in Step S24), the determining section 985 determines that the degree of degradation of the carrier has been increased because of the peel-off of the coating of the carrier (Step S26).

In the case of determining, in Step S23, that the change amount ΔI is larger than the characteristic value threshold value TH (No in Step S23), the determining section 985 determines that the execution timing for the charge amount measurement mode has arrived. The determining section 985 further determines the cause of the increase in the degree of degradation of the carrier in Step S25 or Step S26, and then causes the mode controller 984 to execute the charge amount measurement mode (Step S27). In this manner, the determining section 985 may determine the execution timing for the charge amount measurement mode appropriately according to the change amount ΔI based on the highly precise value of the carrier current that is measured by the ammeter 973 and output as the characteristic value by the mode controller 984. Each time the toner charge amount is acquired in Step S27, the storage 983 stores the acquired toner charge amount in correspondence with the cumulative number of sheets of image formation when the process of Step S27 is executed.

After executing the charge amount measurement mode, the mode controller 984 predicts the time of finish of lifetime of the developer in the developing device 23, based on the transition of the characteristic value stored on the storage 983, and outputs lifetime information on the predicted time of finish of lifetime (Step S28).

Figure 9:
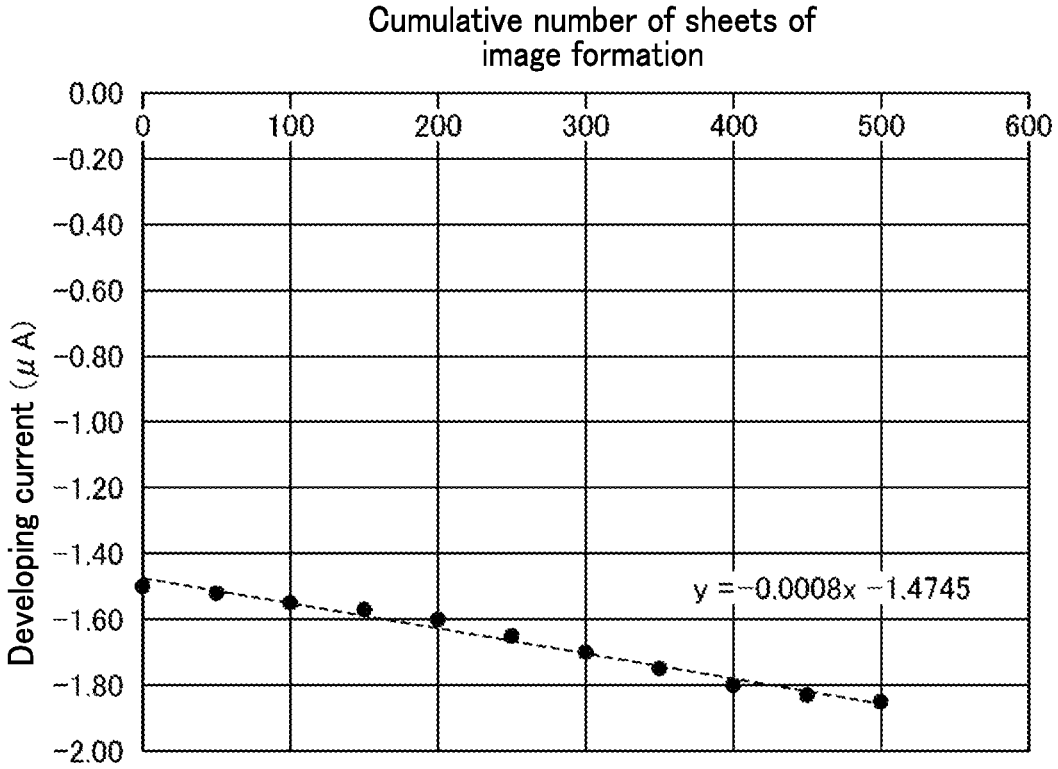
FIG. 9 is a graph showing the relationship between the developing current and the cumulative number of sheets of image formation in the image forming apparatus according to an embodiment of the present disclosure.

FIG. 9 is a graph showing the relationship between the value of the developing current and the cumulative number of sheets of image formation of the image forming apparatus 10 according to an embodiment of the present disclosure. Specifically, in Step S28, the mode controller 984 calculates an approximation straight line (for example, $y=-0.0008\times-1.4745$ (y represents the characteristic value, and x represents the cumulative number of sheets of image formation)) representing the relationship between the characteristic value (DC component of the developing current) stored on the storage 983 and the cumulative number of sheets of image formation put in in correspondence with the characteristic value on the storage 983 as shown in, for example, FIG. 9 by a known approximation technique. The mode controller 984 predicts, as the cumulative number of sheets of image formation at the time of finish of lifetime of the developer, the cumulative number of sheets of image formation (for example, 656.9 K (656900) sheets) when the characteristic value reaches a predetermined upper threshold value or a lower threshold value (for example, −2 μA) on the calculated approximation straight line.

The upper threshold value is defined as, for example, an upper limit of the characteristic values that are output in Step S22 executed a plurality of times when the processes of Step S21 and Step S22 are executed the plurality of times by use of the carrier degraded to a practically problematic level as a result of the peel-off of the coating of the carrier. The lower threshold value is defined as, for example, a lower limit of the characteristic values that are output in Step S22 executed a plurality of times when the processes of Step S21 and Step S22 are executed the plurality of times by use of the carrier degraded to a practically problematic level as a result of the attachment of the toner component to the carrier.

The mode controller 984 displays (outputs), on (to) the display included in the operation panel, a message (lifetime information) notifying a value obtained by subtracting the current cumulative number of sheets of image formation from the cumulative number of sheets of image formation when the predicted time of finish of lifetime arrives, that is, a message notifying the remaining number of sheets on which image formation may be performed until the lifetime of the carrier is over (for example, "Image formation may be formed on another "XX" sheets until the lifetime of the carrier is over."). In this manner, the mode controller 984 outputs the lifetime information on the predicted time of finish of lifetime.

The method for outputting the lifetime information in Step S28 is not limited to the above-described method. For example, in Step S28, the mode controller 984 may store a message indicating the predicted lifetime of the carrier on the storage 983 as the lifetime information. The message indicating the lifetime of the carrier stored on the storage 983 may be provided on a maintenance sheet that is output at the time of maintenance of the image forming apparatus 10. In the case where the image forming apparatus 10 includes a communication interface circuit that communicates with an external device, in Step S28, the mode controller 984 may transmit, as the lifetime information, a signal indicting the predicted lifetime of the carrier to, for example, a predetermined external device such as a service center or a personal computer managing the image forming apparatus 10 via the communication interface circuit. In this case, the external device may manage the lifetime of the carrier for the image forming apparatus 10.

That is, in Step S28, the time of finish of lifetime of the developer in the developing device 23 is predicted based on the transition of the characteristic value according to the value of the carrier current stored on the storage 983. The lifetime information based on the predicted time of finish of lifetime is output. Therefore, the user may easily grasp the time of finish of lifetime of the developer from the output lifetime information.

After Step S28, the determining section 985 corrects the lower limit IL and the upper limit IM included in expression 3 to be used in the determination executed in Step S23 (Step S29). Thus, the procedure is finished.

Specifically, in Step S29, the determining section 985 changes the characteristic value threshold value TH according to the absolute value of a difference between the toner charge amount (hereinafter, referred to as a "first toner charge amount") acquired at the time of execution of the charge amount measurement mode that is executed before the charge amount measurement mode in the latest cycle of Step S27 (acquired at a first execution timing) and the toner charge amount (hereinafter, referred to as a "second toner charge amount") acquired at the time of execution of the charge amount measurement mode in the latest cycle of Step S27 (acquired at a second execution timing). The charge amount measurement mode executed before the charge amount measurement mode in the latest cycle of Step S27 may be executed manually or automatically.

This will be described in more detail. The storage 983 stores thereon in advance an initial value (for example, 0.05 μA) of the characteristic value threshold value TH. As shown in Table 1, the storage 983 stores thereon in advance threshold change information that puts the absolute value ΔQ of the difference between the first toner charge amount and the second toner charge amount, and a post-change characteristic value threshold value THa, into correspondence with each other.

TABLE 1

| ΔQ (μc/g) | THa (μA) |
|---|---|
| ΔQ > 1.5 | 0.03 |
| 1.5 ≥ ΔQ > 1.0 | 0.04 |
| 1.0 ≥ ΔQ ≥ 0.5 | 0.05 |
| 0.5 > ΔQ ≥ 0.2 | 0.06 |
| 0.2 > ΔQ | 0.07 |

According to the threshold change information, the absolute value ΔQ (for example, 1.3 μc/g) larger than the upper limit (first determination threshold value; for example, 1.0 μc/g) of the absolute value ΔQ put into correspondence with a characteristic value threshold value THa (for example, 0.05 μA) that is the same as the initial value (for example, 0.05 μA) of the characteristic value threshold value TH, is put into correspondence with a characteristic value threshold value THa (for example, 0.04 μA) smaller than the initial value of the characteristic value threshold value TH. By contrast, according to the threshold change information, the absolute value ΔQ (for example, 0.4 μc/g) smaller than the lower limit (second determination threshold value; for example, 0.5 μc/g) of the absolute value ΔQ put into correspondence with the characteristic value threshold value THa that is the same as the initial value of the characteristic value threshold value TH, is put into correspondence with a characteristic value threshold value THa (for example, 0.06 μA) larger than the initial value of the characteristic value threshold value TH.

The determining section 985 acquires the characteristic value threshold value THa (for example, 0.04 μA) put into correspondence with the absolute value ΔQ (for example, 1.3 μc/g) of the difference between the first toner charge amount and the second toner charge amount in the threshold change information (Table 1), and changes the current characteristic value threshold value TH (for example, 0.05 μA) to the acquired characteristic value threshold value THa (for example, 0.04 μA).

In this manner, in the case where the absolute value ΔQ is larger than the upper limit of the absolute value ΔQ put into correspondence with the characteristic value threshold value THa that is the same as the initial value of the characteristic value threshold value TH in the threshold change information, the determining section 985 changes the characteristic value threshold value TH such that the characteristic value threshold value TH is smaller than the initial value. In the case where the absolute value ΔQ is smaller than the lower limit of the absolute value ΔQ put into correspondence with the characteristic value threshold value THa that is the same as the initial value of the characteristic value threshold value TH in the threshold change information, the determining section 985 changes the characteristic value threshold value TH such that the characteristic value threshold value TH is larger than the initial value.

The determining section 985 uses the post-change characteristic value threshold value THa to correct the lower limit IL included in expression 3 to be used for the determination in Step S23 to a value (=I0−THa) obtained by subtracting the post-change characteristic value threshold value THa from the reference DC component I0. The determining section 985 corrects the upper limit IM to a value (=I0+THa) obtained by adding the post-change characteristic value threshold value THa to the reference DC component I0.

As such, the determining section 985 may determine the execution timing for the charge amount measurement mode according to the absolute value ΔQ. Therefore, an undesirable possibility may be excluded that the charge amount measurement mode is executed frequently due to the characteristic value threshold value TH being excessively low although the absolute value ΔQ is of such a value that does not require the execution of the charge amount measurement mode. An undesirable possibility may be excluded that the charge amount measurement mode is not executed for a long period of time due to the characteristic value threshold value TH being excessively high although the absolute value ΔQ is of such a value that requires the execution of the charge amount measurement mode.

This will be described in more detail. In the case where the absolute value ΔQ is larger than the upper limit of the absolute value ΔQ put into correspondence in advance with the characteristic value threshold value THa that is the same as the initial value of the characteristic value threshold value TH and thus the toner charge amount acquired in the charge amount measurement mode is significantly changed, the characteristic value threshold value TH may be changed to be smaller than the initial value of the characteristic value threshold value TH. With such a process, in the case where the toner charge amount is significantly changed, the undesirable possibility may be excluded that the charge amount measurement mode is not executed for a long period time due to the characteristic value threshold value TH being excessively high.

By contrast, in the case where the absolute value ΔQ is smaller than the lower limit of the absolute value ΔQ put into correspondence in advance with the characteristic value threshold value THa that is the same as the initial value of the characteristic value threshold value TH and thus the toner charge amount acquired in the charge amount measurement mode is not changed much, the characteristic value threshold value TH may be changed to be larger than the initial value of the characteristic value threshold value TH. With such a process, in the case where the toner charge amount is not changed much, the undesirable possibility may be excluded that the charge amount measurement mode is executed frequently due to the characteristic value threshold value TH being excessively low.

EXAMPLES

Hereinafter, examples in which the charge amount measurement mode is executed at the execution timing determined by the determining section 985 will be described. Experiments were performed under the following conditions.

<Experimental Conditions>

Printing rate: 55 sheets/minute

Photosensitive drum 20: amorphous silicon photosensitive member (α-Si)

Developing roller 231: outer diameter: 20 mm; surface shape: knurling-processed; 80 recessed portions (grooves) are formed in the surface in the circumferential direction Restricting blade 234: formed from SUS430; magnetic; thickness: 1.5 mm Developer conveyance amount after the restricting blade 234: 250 g/cm$^2$ Circumferential speed of the developing roller 231 with respect to the photosensitive drum 20: 1.8 (in the trail direction with the developing roller 231 and the photosensitive drum 20 located opposite to each other)

Distance between the photosensitive drum 20 and the developing roller 231: 0.30 mm Background region of the photosensitive drum 20 (non-image forming region) potential V0: +270 V Image region of the photosensitive drum 20 (image forming region) potential VL: +20V Toner: positively chargeable toner; mean volume particle diameter: 6.8 μm; toner density: 8%

Carrier: mean volume particle diameter: 35 μm; coated with ferrite-resin coating Developing bias of the developing roller 231: frequency: 4.2 kHz, duty: 50%; Vpp: 900-V AC voltage square wave; Vdc (DC voltage): 180 V

First Example

The initial value of the characteristic value threshold value TH was set to 0.05 μA. After the image forming apparatus 10 was started, the mode controller 984 was caused to execute the charge amount measurement mode under the above-described experimental conditions when the cumulative number of sheets of image formation was 0. Then, a first experiment was performed as follows. The processes of Steps S21 and thereafter illustrated in FIG. 8 except for Step S29 were repeated until the charge amount measurement mode was executed seven times while the characteristic value threshold value was kept at the initial value and while known toner density control was performed such that the toner density would be 8±1%. The results of the first experiment are shown in Table 2.

TABLE 2

| | Cumulative number of sheets of image formation (unit: 1000 sheets) | | | | | | | | | | |
|---|---|---|---|---|---|---|---|---|---|---|---|
| | 0 | 50 | 100 | 150 | 200 | 250 | 300 | 350 | 400 | 450 | 500 |
| Developing current (μA) | −1.50 | −1.52 | −1.55 | −1.57 | −1.60 | −1.65 | −1.70 | −1.75 | −1.80 | −1.83 | −1.85 |
| Toner density (%) | 8.0 | 7.8 | 8.2 | 7.8 | 8.2 | 8.2 | 7.6 | 8.0 | 7.8 | 7.6 | 7.8 |
| Change amount in developing current (μA) | | 0.02 | 0.05 | 0.02 | 0.05 | 0.05 | 0.05 | 0.05 | 0.05 | 0.03 | 0.05 |
| Charge amount measurement | ○ | | ○ | | ○ | ○ | ○ | ○ | ○ | | ○ |

In the first experiment, as shown in Table 2, when the cumulative number of sheets of image formation was 100K, 200K, 250K, 300K, 350K, 400K, and 500K, the DC component of the developing current output as the characteristic value in Step S22 was changed by at least the characteristic value threshold value TH (0.05 μA) with respect to the reference DC component I0 (DC component of the developing current output as the characteristic value in Step S22 executed after the development operation of the measurement toner images in the latest cycle of charge amount measurement mode), and the charge amount measurement mode was executed. Based on this, it has been found that even in the case where the process of Step S29 is not executed, the timing of executing the charge amount measurement mode can determined more efficiently than in the case where the charge amount measurement mode is executed each time the cumulative number of sheets of image formation is increased by 50 sheets.

Second Example

Like in the first example, the initial value of the characteristic value threshold value TH was set to 0.05 μA. After the image forming apparatus 10 was started, the mode controller 984 was caused to execute the charge amount measurement mode under the above-described experimental conditions when the cumulative number of sheets of image formation was 0. Then, a second experiment was performed as follows. The processes of Steps S21 and thereafter illustrated in FIG. 8 were repeated until the charge amount measurement mode was executed seven times while known toner density control was performed such that the toner density would be 8±1%. In Step S29 (FIG. 8), the characteristic value threshold value TH was corrected to the characteristic value threshold value TH put into correspondence with the absolute value ΔQ of the difference between the first toner charge amount and the second toner charge amount in Table 1. The results of the second experiment are shown in Table 3.

TABLE 3

| | Cumulative number of sheets of image formation (unit: 1000 sheets) | | | | | | | | | |
|---|---|---|---|---|---|---|---|---|---|---|
| | 0 | 50 | 100 | 150 | 190 | 230 | 300 | 350 | 430 | 500 |
| Developing current (μA) | −1.50 | −1.52 | −1.55 | −1.57 | −1.59 | −1.63 | −1.68 | −1.74 | −1.81 | −1.87 |
| Change amount in developing current (μA) | | 0.02 | 0.05 | 0.02 | 0.04 | 0.04 | 0.05 | 0.06 | 0.07 | 0.06 |
| Charge amount measurement | ○ | | ○ | | ○ | ○ | ○ | ○ | ○ | ○ |
| Charge amount (μc/g) | 28.2 | | 27.1 | | 25.8 | 25 | 24.6 | 24.5 | 24.2 | 24.0 |
| Toner density (%) | 8.0 | 7.8 | 8.1 | 7.7 | 7.8 | 7.6 | 7.7 | 8.2 | 7.8 | 8.0 |
| Change amount in charge amount (μc/g) | | | 1.1 | | 1.3 | 0.8 | 0.4 | 0.1 | 0.3 | 0.2 |
| Characteristic value threshold value (μA) | 0.05 | | 0.04 | | 0.04 | 0.05 | 0.06 | 0.07 | 0.06 | 0.07 |

In the second experiment, unlike in the first experiment, as shown in Table 3, when the cumulative number of sheets of image formation was 100K, 190K, 230K, 300K, 350K, 430K, and 500K, the charge amount measurement mode was executed. Based on this, it has been found that in the case where the process of Step S29 is executed, the timing of executing the charge amount measurement mode can also be determined more efficiently than in the case where the charge amount measurement mode is executed each time the cumulative number of sheets of image formation is increased by 50 sheets.

When the cumulative number of sheets of image formation was 100K and 190K, the absolute value ΔQ of the difference between the first toner charge amount and the second toner charge amount, shown in Table 3 as the change amount in the charge amount, was larger than 1.0 μc/g, which was the upper limit of the absolute value ΔQ put into correspondence with the characteristic value threshold value THa same as the initial value of the characteristic value threshold value TH in Table 1. Therefore, in Step S29, the characteristic value threshold value TH was changed to 0.04 μA, which was smaller than the initial value of the characteristic value threshold value TH. When the cumulative number of sheets of image formation was 300K, 350K, 430K, and 500K, the absolute value ΔQ shown as the change amount in the charge amount in Table 3 was smaller than 0.5 μc/g, which was the lower limit of the absolute value ΔQ put into correspondence with the characteristic value threshold value THa same as the initial value of the characteristic value threshold value TH in Table 1. Therefore, in Step S29, the characteristic value threshold value TH was set to 0.06 μA or 0.07 μA, which was larger than the initial value of the characteristic value threshold value TH. Based on the second experiment, it has been found that the execution timing for the charge amount measurement mode can be appropriately adjusted according to the change in the toner charge amount, by changing the characteristic value threshold value TH according to the absolute value ΔQ in Step S29.

According to the present embodiment, during the non-development operation time period, the mode controller 984 acquires the charge amount of the toner contained in the plurality of measurement toner images formed on the photosensitive drums 20, based on the density of each of the plurality of measurement toner images detected by the density sensor 100. Therefore, the toner charge amount may be acquired with high precision by use of the measurement toner images during a time period in which the development operation accompanying the image formation operation is not performed.

The determining section 985 determines the execution timing for the charge amount measurement mode according to the value of the carrier current that is output as a characteristic value by the mode controller 984. In this manner, the execution timing for the charge amount measurement mode to be executed in the future is determined according to the value of the carrier current. Therefore, the toner charge amount that is changed according to the degree of degradation of the carrier can be acquired efficiently.

Therefore, as compared with the case where the charge amount measurement mode is executed at a preset execution timing regardless of the degree of degradation of the carrier or the toner charge amount, the change in the toner charge amount can be measured efficiently. In other words, the operation of acquiring the charge amount can be prevented from being executed excessively frequently in a time period in which the toner charge amount is small.

Embodiments of the present disclosure have been described so far. The present disclosure is not limited to any of the above-described embodiments. For example, the following variations may be provided.

(1) In the case where the toner density, which represents the ratio of the amount of the toner with respect to the amount of the carrier contained in the developer accommodated in the developing device 23 is high, the resistance of the magnetic brush formed between the developing roller 231 and the photosensitive drum 20 is increased. Through the above influenced, the value of the developing current measured while the mode controller 984 applies the developing bias to the non-image forming region at the measurement timing in Step S22 (FIG. 8) may be undesirably lower than in the case where the toner density is of a specified value. Thus, in order to remove the influence exerted by the change in the toner density on the measured value of the developing current, the measured value of the developing current may be corrected according to the toner density.

Figure 10:
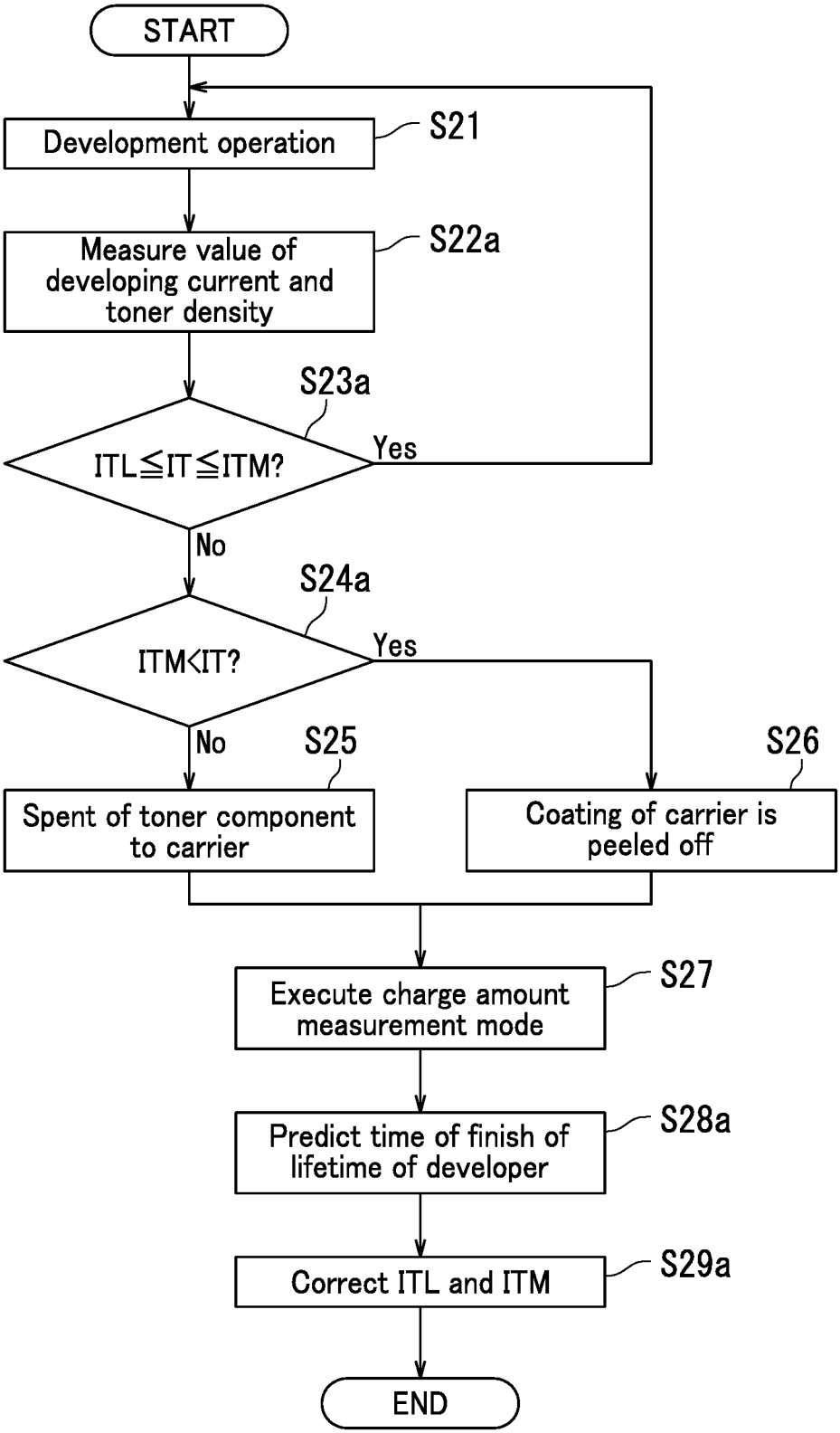
FIG. 10 is a flowchart illustrating an operation of determining the execution timing for the charge amount measurement mode executed by an image forming apparatus according to a variation of the present disclosure.

Specifically, as illustrated in FIG. 2, the development housing 230 may include a toner sensor TS (toner density detecting section) that detects the toner density, which represents the ratio of the amount of the toner with respect to the amount of the carrier contained in the developer accommodated in the developing device 23. The toner sensor TS may include a known magnetic permeability sensor, pressure sensor, or the like. FIG. 10 is a flowchart illustrating an operation of determining the execution timing for the charge amount measurement mode in an image forming apparatus 10 according to a variation of the present disclosure. Steps S22 through S24 illustrated in FIG. 8 may be changed to Steps S22*a* through S24*a* illustrated in FIG. 10. In addition. Step 28 and Step 29 illustrated in FIG. 8 may be changed to Step 28*a* and Step 29*a* illustrated in FIG. 10.

This will be described in more detail. In Step S22*a*, the mode controller 984 may output, as the characteristic value, a value IT obtained by correcting the DC component I, of the developing current measured by the ammeter 973 at the measurement timing, according to the toner density detected by the toner sensor TS at the measurement timing. Specifically, the mode controller 984 may follow, for example, expression 7 shown below to correct the value of the DC component I of the developing current measured by the ammeter 973 such that the value of the DC component I increases as the toner density detected by the toner sensor TS is increased.

$$IT = I \times C \times T / T0 \qquad \text{expression 7}$$

In expression 7, C represents a predetermined correction coefficient of 1 or greater (for example, 1.2). T represents the toner density detected by the toner sensor TS (for example, 10%). T0 represents the specified value of the toner density (for example, 8%).

Each time the characteristic value is output in Step S22*a*, the storage 983 stores the output characteristic value in correspondence with the cumulative number of sheets of image formation when the process of Step S22*a* is executed. The value stored according to the characteristic value is not limited to the cumulative number of sheets of image formation, but may be the cumulative driving time period of the developing device 23 or the image forming apparatus 10, or a value obtained from a function (mathematical expression) using these values.

In Step S23*a*, like in Step S23, the determining section 985 determiners whether or not a change amount in the characteristic value (second characteristic value) output by the mode controller 984 at the latest cycle of Step S22*a* (second measurement timing), with respect to the characteristic value (first characteristic value) output by the mode controller 984 in the cycle of Step S22*a* executed before the latest cycle of Step S22*a* (first measurement timing), is larger than a preset characteristic value threshold value THb (Step S23*a*).

Specifically, in Step S23*a*, the determining section 985 determines whether or not expression 8 below is fulfilled. In expression 8, IT represents a value obtained by correcting the DC component, of the developing current that is output as the characteristic value in the latest cycle of Step S22*a*, according to the toner density (hereinafter, the IT will be referred to as a "corrected DC component"). ITL represents a predetermined lower limit of the corrected DC component that is output as the characteristic value. ITM represents a predetermined upper limit of the corrected DC component that is output as the characteristic value.

$$ITL \leq IT \leq ITM \quad \text{expression 8}$$

The lower limit ITL is defined as a value (=IT0−THb) obtained by subtracting a characteristic value threshold value THb from a corrected DC component IT0 that is output as the characteristic value in Step S22*a* executed during the development operation of developing the measurement toner images in the latest cycle of charge amount measurement mode (hereinafter, the above-described corrected DC component IT0 will be referred to as a "reference corrected DC component IT0). The upper limit ITM is defined as a value (=IT0+THb) obtained by adding the characteristic value threshold value THb to the reference corrected DC component IT0.

Therefore, as described later, expression 8 may be deformed to expression 9, expression 10, and expression 11 by use of a change amount |IT−IT0| of the corrected DC component IT that is output as the characteristic value in the latest cycle of Step S22*a*, with respect to the reference corrected DC component IT0 (hereinafter, the above-described change amount |IT−IT0| will be referred to as a "change amount ΔIT).

$$IT0-THb \leq IT \leq IT0+THb \quad \text{expression 9}$$

$$-THb \leq IT-IT0 \leq THb \quad \text{expression 10}$$

$$\Delta IT \leq THb \quad \text{expression 11}$$

That is, the determining section 985 determines, in Step S23*a*, whether or not expression 8 is fulfilled, and thus determines whether the change amount ΔIT of the corrected DC component IT that is output as the characteristic value in the latest cycle of Step S22*a*, with respect to the reference corrected DC component IT0, is no larger than the characteristic value threshold value THb or larger than the characteristic value threshold value TH as represented by expression 11b.

In the case where it is determined in Step S23*a* that expression 11 is fulfilled and thus the change amount ΔIT is no larger than the characteristic value threshold value THb (Yes in Step S23*a*), the determining section 985 determines that it is not necessary to re-acquire the toner charge amount, and returns the procedure to Step S21. By contrast, in the case where it is determined in Step S23*a* that expression 11 is not fulfilled and thus the change amount ΔIT is larger than the characteristic value threshold value THb (No in Step S23*a*), the determining section 985 determines that it is necessary to re-acquire the toner charge amount, and determines that the execution timing for the charge amount measurement mode has arrived. In this case, the determining section 985 can determine the execution timing for the charge amount measurement mode more appropriately, with the influence exerted by the change in the toner density on the measured value of the developing current being removed.

Now, it is assumed that it is determined in Step S23*a* that expression 11 is not fulfilled and thus the change amount ΔIT is larger than the characteristic value threshold value THb (No in Step S23*a*). In the case where the corrected DC component IT that is output as the characteristic value in Step S22*a* is smaller than the lower limit ITL (ITL>IT) (No in Step S24*a*), the determining section 985 determines that the degree of degradation of the carrier has been increased because of spent of the toner component to the carrier (Step S25). By contrast, in the case where the corrected DC component IT that is output as the characteristic value in Step S22*a* is larger than the upper limit ITM (ITM<IT) (Yes in Step S24*a*), the determining section 985 determines that the degree of degradation of the carrier has been increased because of peel-off of the coating of the carrier (Step S26).

In Step S28*a*, like in Step S28, the mode controller 984 calculates an approximation straight line that represents a transition of the characteristic value (corrected DC component IT) stored on the storage 983, predicts the time of finish of lifetime of the developer in the developing device 23 by use of the approximation straight line, and outputs lifetime information on the predicted time of finish of lifetime (Step S28*a*).

In Step S29*a*, the determining section 985 corrects the lower limit ITL and the upper limit ITM included in expression 8 to be used in the determination executed in Step S23*a*.

Specifically, in Step S29*a*, the determining section 985 changes the characteristic value threshold value THb according to the absolute value of a difference between the logical product of the toner charge amount (hereinafter, referred to as a "first toner charge amount") acquired at the time of execution of the charge amount measurement mode that is executed before the charge amount measurement mode in the latest cycle of Step S27 (acquired at a first execution timing) and the toner density (hereinafter, referred to as a first toner density) detected at the first execution timing, and the logical product of the toner charge amount (hereinafter, referred to as a "second toner charge amount") acquired at the time of execution of the charge amount measurement mode in the latest cycle of Step S27 (acquired at a second execution timing) and the toner density (hereinafter, referred to as a second toner density) detected at the second execution timing. The charge amount measurement mode executed before the charge amount measurement mode in the latest cycle of Step S27 may be executed manually or automatically.

This will be described in more detail. The storage 983 stores therein in advance an initial value (for example, 0.05 μA) of the characteristic value threshold value THb. As shown in Table 4 below, the storage 983 stores thereon in advance threshold change information that puts the absolute value ΔQT of the difference between the logical product of the first toner charge amount and the first toner density (hereinafter, referred to as a "first logical product") and the logical product of the second toner charge amount and the second toner density (hereinafter, referred to as a "second logical product") into correspondence with a post-change characteristic value threshold value THc.

TABLE 4

| ΔQT (μc/g · %) | THc (μA) |
|---|---|
| ΔQT > 12 | 0.03 |
| 12 ≥ ΔQT > 8 | 0.04 |
| 8 ≥ ΔQT ≥ 4 | 0.05 |
| 4 > ΔQT | 0.06 |

According to the threshold change information, the absolute value ΔQT (for example, 9 μc/g. %) larger than the upper limit (first determination threshold value; for example, 8 μc/g. %) of the absolute value ΔQT put into correspondence with a characteristic value threshold value THc (for example, 0.05 μA) that is the same as the initial value (for example, 0.05 μA) of the characteristic value threshold value THb, is put into correspondence with a characteristic value threshold value THc (for example, 0.04 μA) smaller than the initial value of the characteristic value threshold value THb. By contrast, according to the threshold change information, the absolute value ΔQT (for example, 3 μc/g. %) smaller than the lower limit (second determination threshold value; for example, 4 μc/g. %) of the absolute value ΔQT put into correspondence with the characteristic value threshold value THc that is the same as the initial value of the characteristic value threshold value THb, is put into correspondence with a characteristic value threshold value THc (for example, 0.06 μA) larger than the initial value of the characteristic value threshold value THb.

The determining section 985 acquires the characteristic value threshold value THc (for example, 0.04 μA) put into correspondence with the absolute value ΔQT (for example, 9 μc/g) of the difference between the first logical product and the second logical product in the threshold change information (Table 4), and changes the current characteristic value threshold value THb (for example, 0.05 μA) to the acquired characteristic value threshold value THc (for example, 0.04 μA).

In this manner, in the case where the absolute value ΔQT is larger than the upper limit of the absolute value ΔQT put into correspondence with the characteristic value threshold value THc that is the same as the initial value of the characteristic value threshold value THb in the threshold change information, the determining section 985 changes the characteristic value threshold value THb such that the characteristic value threshold value THb is smaller than the initial value. In the case where the absolute value ΔQT is smaller than the lower limit of the absolute value ΔQT put into correspondence with the characteristic value threshold value THc that is the same as the initial value of the characteristic value threshold value THb in the threshold change information, the determining section 985 changes the characteristic value threshold value THb such that the characteristic value threshold value THb is larger than the initial value.

The determining section 985 uses the post-change characteristic value threshold value THb to correct the lower limit ITL included in expression 8 to be used for the determination in Step S23*a* to a value (=IT0−THc) obtained by subtracting the post-change characteristic value threshold value THc from the reference corrected DC component IT0. The determining section 985 corrects the upper limit ITM to a value (=IT0+THc) obtained by adding the post-change characteristic value threshold value THc to the reference corrected DC component IT0.

As such, the determining section 985 can determine the execution timing for the charge amount measurement mode according to the absolute value ΔQT. Therefore, an undesirable possibility may be excluded that the charge amount measurement mode is executed frequently due to the characteristic value threshold value THb being excessively low although the absolute value ΔQT is of such a value that does not require the execution of the charge amount measurement mode. An undesirable possibility may also be excluded that the charge amount measurement mode is not executed for a long period of time due to the characteristic value threshold value THb being excessively high although the absolute value ΔQT is of such a value that requires the execution of the charge amount measurement mode.

This will be described in more detail. In the case where the absolute value ΔQT is larger than the upper limit of the absolute value ΔQT put into correspondence in advance with the characteristic value threshold value THc that is the same as the initial value of the characteristic value threshold value THb and thus the toner charge amount acquired in the charge amount measurement mode is significantly changed, the characteristic value threshold value THb may be changed to be smaller than the initial value of the characteristic value threshold value THb. With such a process, in the case where the toner charge amount is significantly changed, the undesirable possibility may be excluded that the charge amount measurement mode is not executed for a long period time due to the characteristic value threshold value THb being excessively high.

By contrast, in the case where the absolute value ΔQT is smaller than the lower limit of the absolute value ΔQT put into correspondence in advance with the characteristic value threshold value THc that is the same as the initial value of the characteristic value threshold value THb and thus the toner charge amount acquired in the charge amount measurement mode is not changed much, the characteristic value threshold value THb may be changed to be larger than the initial value of the characteristic value threshold value THb. With such a process, in the case where the toner charge amount is not changed much, the undesirable possibility may be excluded that the charge amount measurement mode is executed frequently due to the characteristic value threshold value THb being excessively low.

Third Example

In this example also, like in the first example and the second example, the initial value of the characteristic value threshold value THb was set to 0.05 μA. After the image forming apparatus 10 was started, the mode controller 984 was caused to execute the charge amount measurement mode under the above-described experimental conditions when the cumulative number of sheets of image formation was 0. Then, a third experiment was performed as follows. The processes of Steps S21 and thereafter illustrated in FIG. 10 were repeated until the charge amount measurement mode was executed seven times while known toner density control was performed such that the toner density would be 8±1%. In Step S29*a* (FIG. 10), the characteristic value threshold value THb was corrected to the characteristic value threshold value THc put into correspondence with the absolute value ΔQT of the difference between the first logical product and the second logical product in Table 4. The results of the third experiment are shown in Table 5.

TABLE 5

| | Cumulative number of sheets of image formation (unit: 1000 sheets) | | | | | | | | | |
|---|---|---|---|---|---|---|---|---|---|---|
| | 0 | 50 | 100 | 150 | 200 | 235 | 300 | 340 | 420 | 480 |
| Developing current in non-image region (μA) | −1.50 | −1.52 | −1.55 | −1.57 | −1.60 | −1.63 | −1.69 | −1.74 | −1.77 | −1.8 |
| Change amount in developing current (μA) | 0.05 | 0.02 | 0.05 | 0.02 | 0.05 | 0.03 | 0.06 | 0.05 | 0.03 | 0.03 |
| Charge amount measurement | ○ | | ○ | | ○ | ○ | ○ | ○ | ○ | ○ |
| Charge amount (μc/g) | 28.2 | | 27.1 | | 26.1 | 25.1 | 24.6 | 25.0 | 24.3 | 24.0 |
| Toner density (%) | 8.0 | 7.8 | 8.1 | 7.7 | 7.6 | 7.8 | 7.7 | 8.2 | 7.9 | 8.0 |
| Charge amount × toner density (μc/g · %) | 225.6 | | 219.51 | | 198.36 | 195.78 | 189.42 | 205 | 191.97 | 192 |
| Change amount in (charge amount × toner density)(μc/g · %) | | | 6.09 | | 21.15 | 2.58 | 6.36 | 15.58 | 13.03 | 0.03 |
| Characteristic value threshold value (μA) | 0.05 | | 0.05 | | 0.03 | 0.06 | 0.05 | 0.03 | 0.03 | 0.06 |

In the third experiment, as shown in Table 5, when the cumulative number of sheets of image formation was 100K, 200K, 235K, 300K, 340K, 420K, and 480K, the charge amount measurement mode was executed. Based on this, it has been found that the timing of executing the charge amount measurement mode can be determined more efficiently than in the case where the charge amount measurement mode is executed each time the cumulative number of sheets of image formation is increased by 50 sheets.

When the cumulative number of sheets of image formation was 200K, 340K, and 420K, the absolute value ΔQT, shown as the change amount in the column (charge amount× toner density) in Table 5, of the difference between the first logical product and the second logical product was larger than 8 μc/g. %, which was the upper limit of the absolute value ΔQT put into correspondence with the characteristic value threshold value THc same as the initial value of the characteristic value threshold value THb in Table 4. Therefore, in Step S29*a*, the characteristic value threshold value THb was changed to 0.03 μA, which was smaller than the initial value of the characteristic value threshold value THb. When the cumulative number of sheets of image formation was 235K and 480K, the absolute value ΔQT shown as the change amount in the column (charge amount×toner density) in Table 5 was smaller than 4 μc/g. %, which was the lower limit of the absolute value ΔQT put into correspondence with the characteristic value threshold value THc same as the initial value of the characteristic value threshold value THb in Table 4. Therefore, in Step S29*a*, the characteristic value threshold value THb was set to 0.06 μA, which was larger than the initial value of the characteristic value threshold value THb. Based on the third experiment, it has been found that the execution timing for the charge amount measurement mode can be appropriately adjusted according to the changes in the toner charge amount and the toner density through changing the characteristic value threshold value THb according to the absolute value ΔQT in Step S29*a*.

(2) In the embodiments and the variations described above, the surface of the developing roller 213 is subjected to knurling. Alternatively, the surface of the developing roller 213 may have a recessed portion (dimple) or may be blasted.

(3) In the case where the image forming apparatus 10 includes a plurality of developing devices 23 as illustrated in FIG. 1, the charge amount measurement mode according to the embodiments or the variations described above may be executed by one or two developing devices 23, and the results thereof may be used by remaining developing device 23.

Figure 11:
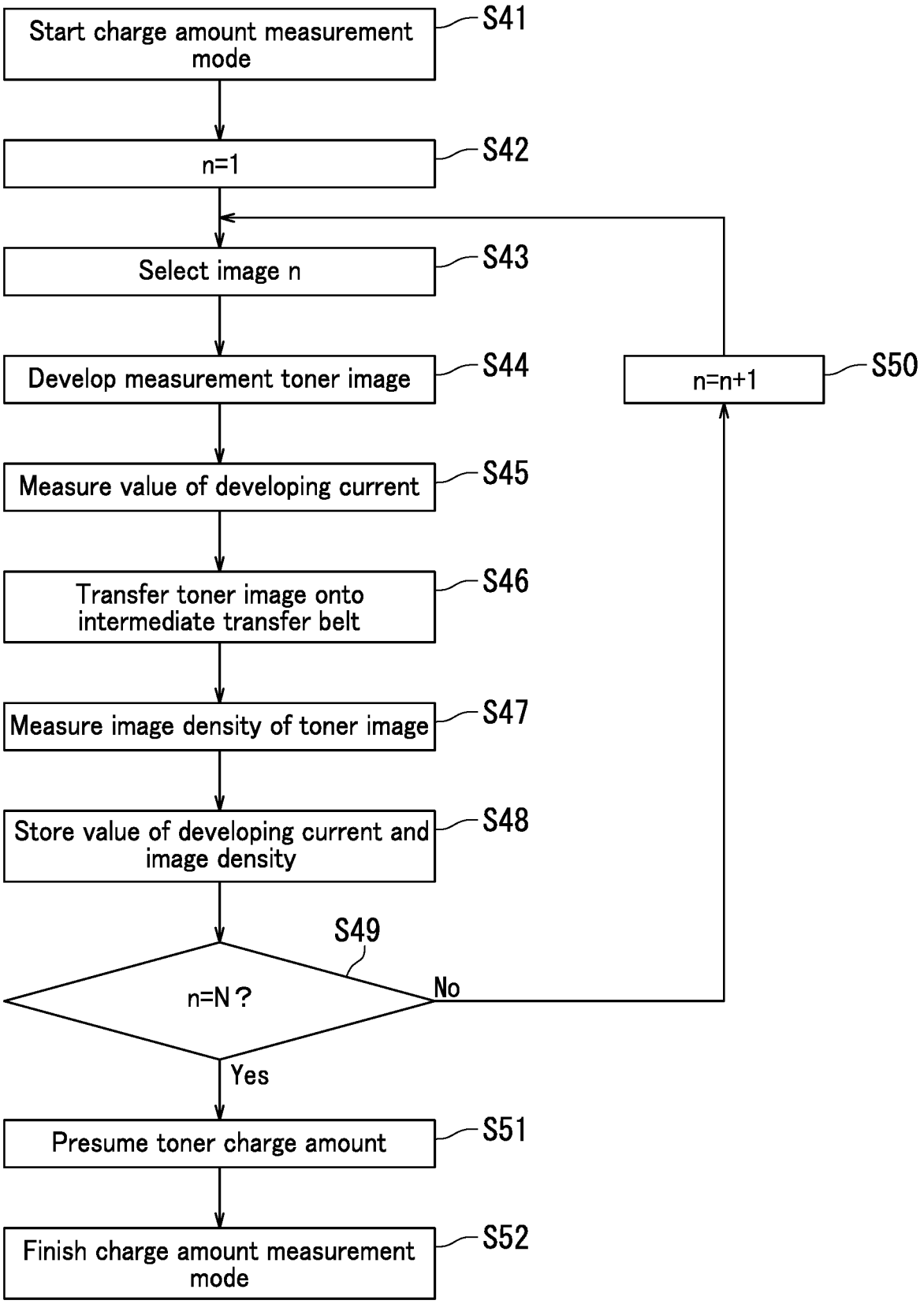
FIG. 11 is a flowchart of the charge amount measurement mode executed by an image forming apparatus according to a variation of the present disclosure.

(4) In the embodiments and the variations described above, in the charge amount measurement mode, the mode controller 984 acquires the charge amount of the toner contained in the measurement toner images formed on the photosensitive drum 20 based on the gradients of the measurement straight lines and the reference information stored on the storage 983. The present disclosure is not limited to this. FIG. 11 is a flowchart of a charge amount measurement mode executed by an image forming apparatus 10 according to this variation.

In this variation, in the charge amount measurement mode, the mode controller 984 forms a plurality of measurement toner images on the photosensitive drums 20 while changing the frequency of the AC voltage of the developing bias in the state in which the potential difference in the DC voltage between the developing roller 231 and the photosensitive drum 20 is kept constant. The mode controller 984 acquires the charge amount of the toner contained in the measurement toner images formed on the photosensitive drum 20, based on the ratio of the difference in the DC component among the developing currents flowing between the developing roller 231 and the developing bias applying section 971 when the plurality of measurement toner images are formed, with respect to the difference in the toner density, among the plurality of measurement toner images, detected by the density sensor 100.

As illustrated in FIG. 11, when starting the charge amount measurement mode (Step S41), the mode controller 984 sets a variable n to be used to form the plurality of measurement toner images to n=1 (Step 42). The mode controller 984 selects an image 1 stored in advance on the storage 983 and corresponding to n=1 (Step S43). The storage 983 stores thereon image information on an electrostatic latent image to form an image n and information on the frequency of the AC voltage of the developing bias. The other parameters regarding the image formation operation are set to the same values as those in the immediately previous cycle of image formation operation. Next, the mode controller 984 controls the exposure device 22 (FIG. 1), the driving controller 981, and the bias controller 982 to rotate the developing roller 231 by one or more rotations in the state in which the developing bias to be used to form the image 1 is applied to the developing roller 231, and then forms an electrostatic latent image for the measurement toner image corresponding to the image 1 on the photosensitive drum 20. Along with the rotation of the photosensitive drum 20, the measurement toner image passes the developing nip part NP in which the photosensitive drum 20 and the developing roller 231 are opposite to each other. At this point, the toner is supplied to the electrostatic latent image and thus the measurement toner image is developed (Step S44). During the development operation, the value of the developing current (DC current) is measured by the ammeter 973 (Step S47).

Then, the toner image is transferred from the photosensitive drum 20 onto the intermediate transfer belt 141 (Step S46). The image density of the measurement toner image is measured by the density sensor 100 (Step S47). The measured image density is stored on the storage 983 together with the value of the developing current measured in Step S35 (Step S48).

Next, the mode controller 984 determines whether or not the variable n to be used to form the plurality of measurement toner images has reached a preset specified number of times N (Step S49). In the case where n≠N (No in Step S49), the value of n is counted up by one (n=n+1; Step S50). The processes of Steps S43 through S49 are repeated. In order to increase the precision of the charge amount measurement, the specified number of times N is desirably 2≤N, and is more desirably 3≤N. By contrast, in the case where n=N (Yes in Step S49), the mode controller 984 estimates the toner charge amount (Step S51). Thus, the charge amount measurement mode is finished (Step S52).

In an example, in the case where N=2, the values of the developing current (DC current) at n=1 and n=2 measured in Step S45 are respectively defined as I1 and I2. The image densities at n=1 and n=2 measured in Step S47 are respectively defined as ID 1 and ID2. In this case, the toner charge amount in Step S51 corresponds to gradient "a" acquired from expression 12 shown below.

$$\text{Gradient } a=(I1-I12)/(\text{ID1}-\text{ID2}) \qquad \text{expression 12}$$

In a graph in which the horizontal axis represents the image density ID and the vertical axis represents the developing current I, data (ID, I) at n=1 and n=2 is plotted to provide two points. Gradient "a" corresponds to a gradient of a straight line passing the two points. In the case where the toner charge amount is measured under the condition of 3≤N, the gradient "a" of the approximation straight line of the primary expression found by the least squares method represents the toner charge amount.

In another variation, the parameter that is changed when the plurality of measurement toner images are formed may be the coverage rate of the electrostatic latent images formed by the exposure device 22, instead of the frequency of the AC voltage of the developing bias.

That is, in this variation, the mode controller 984 forms a plurality of measurement toner images on the photosensitive drums 20 while changing the coverage rate per unit area by controlling the exposure device 22 in the state in which the potential difference in the DC voltage between the developing roller 231 and the photosensitive drum 20 is kept constant. The mode controller 984 may acquire the charge amount of the toner contained in the measurement toner images formed on the photosensitive drums 20, based on the ratio of the difference in the DC components among the developing currents flowing between the developing roller 231 and the developing bias applying section 971 when the plurality of measurement toner images are formed, with respect to the difference in the toner density, among the plurality of measurement toner images, detected by the density sensor 100. In this case also, like in the variation described above, the toner charge amount may be acquired based on expression 12.

(5) In the embodiments and the variations described above, the mode controller 984 may further execute a calibration operation of adjusting parameters that define the image quality of the toner image to be transferred onto the sheet. The parameters include the rotation rate of the photosensitive drum 20, the potential at which the surface of the photosensitive drum 20 is charged by the charger 21, the developing bias to be applied to the developing roller 231, the amount of light to be directed toward the exposure device 22, and the like. In Step S27, the mode controller 984 executes the calibration operation of forming the plurality of measurement toner images on the photosensitive drums 20 while changing the developing bias. The plurality of measurement toner images may be used to execute the charge amount measurement mode.

(6) In the above-described embodiments, the mode controller 984 may not execute the process of Step S28 (FIG. 8). In the above-described variations, the mode controller 984 may not execute the process of Step S28*a* (FIG. 10).

(7) In the above-described embodiments, the mode controller 984 may not execute the process of Step S29 (FIG. 8). In the above-described variation, the mode controller 984 may not execute the process of Step S29*a* (FIG. 10).

What is claimed is:

1. An image forming apparatus, comprising:

an image bearing member that is rotatable, that is configured to allow an electrostatic latent image to be formed on a surface thereof and bear a toner image obtained as a result of the electrostatic latent image being made visible;

a charger configured to charge the image bearing member with a predetermined charge potential;

an exposure device configured to expose the surface of the image bearing member charged with the predetermined charge potential to light according to predetermined image information to form the electrostatic latent image;

a developing device located opposite to the image bearing member in a predetermined developing nip part, the developing device including a rotatable developing roller that is rotatable, that is configured to form the toner image by bearing a developer on a circumferential surface thereof and supplying the toner to the image bearing member having the electrostatic latent image formed thereon, the developer containing a toner and a carrier;

a developing bias applying section configured to apply a developing bias to the developing roller, the developing bias including an AC voltage superposed on an DC voltage;

a first density sensor configured to detect a density of the toner image;

an ammeter configured to measure a DC component of a developing current flowing between the developing roller and the developing bias applying section;

storage that stores predetermined information and a control program thereon; and a processor, wherein the processor executes the control program to function to include a charge amount acquiring section, a characteristic value outputting section, and an execution timing determining section, the charge amount acquiring section controls the charger, the exposure device, and the developing bias applying section at a predetermined execution timing during a non-development operation time period to form a plurality of measurement toner images developed with different amounts of the toner from each other on the image bearing member, and executes a charge amount acquisition operation of acquiring a charge amount of the toner contained in each of the plurality of measurement toner images formed on the image bearing member, based on the density of each of the plurality of measurement toner images detected by the first density sensor, or based on a DC component of the developing current measured by the ammeter at the time of formation of the plurality of measurement toner images as well as based on the density of each of the plurality of measurement toner images, the non-development operation time period being different from a development operation time period in which the toner image is formed on the image bearing member, the characteristic value outputting section acquires the DC component of the developing current measured by the ammeter at a predetermined measurement timing, and outputs a characteristic value according to the DC component of the developing current, the predetermined measurement timing being a timing at which a non-image forming region of the surface of the image bearing member faces the developing roller in the entirety of an axial direction and an electric field in a direction in which the toner moves from the image bearing member toward the developing roller by a potential difference between a surface potential of the image bearing member and the DC component of the developing bias is formed in the developing nip part, the execution timing determining section determines the execution timing for the charge amount acquisition operation according to the characteristic value output by the characteristic value outputting section, the image forming apparatus further comprises a second density sensor that is located at the developing device and that is configured to detect a toner density that represents a ratio of an amount of the toner with respect to an amount of the carrier contained in the developer accommodated in the developing device, and the characteristic value outputting section outputs, as the characteristic value, a value obtained by correcting the DC component of the developing current measured by the ammeter at the measurement timing according to the toner density detected by the toner density detecting section at the measurement timing.

2. The image forming apparatus according to claim 1, wherein in the case where a change amount between a first characteristic value output by the characteristic value outputting section at a first measurement timing and a second characteristic value output by the characteristic value outputting section at a second measurement timing after the first measurement timing is larger than a preset characteristic value threshold value, the execution timing determining section determines that the execution timing has arrived and causes the charge amount acquiring section to execute the charge amount acquisition operation.

3. The image forming apparatus according to claim 1, wherein the characteristic value outputting section outputs, as the characteristic value, the DC component of the developing current measured by the ammeter.

4. The image forming apparatus according to claim 1, wherein the execution timing determining section changes the characteristic value threshold value according to an absolute value of a difference between a first toner charge and a second toner charge amount, the first toner charge amount being the charge amount of the toner acquired at a first execution timing, and a second toner charge amount, the second toner charge amount being the charge amount of the toner acquired at a second execution timing after the first execution timing.

5. The image forming apparatus according to claim 4, wherein in the case where the absolute value is larger than a preset first determination threshold value, the execution timing determining section changes the characteristic value threshold value such that the characteristic value threshold value is decreased.

6. The image forming apparatus according to claim 4, wherein in the case where the absolute value is smaller than a preset second determination threshold value, the execution timing determining section changes the characteristic value threshold value such that the characteristic value threshold value is increased.

7. The image forming apparatus according to claim 1, wherein the execution timing determining section changes the characteristic value threshold value according to an absolute value of a difference between a logical product of a first toner charge amount and a first toner density and a logical product of a second toner charge amount and a second toner density, the first toner charge amount being is the charge amount of the toner acquired at a first execution timing, the first toner density being is the toner density detected at the first execution timing, the second toner charge amount being the charge amount of the toner acquired at a second execution timing after the first execution timing, the second toner density being the toner density detected at the second execution timing.

8. The image forming apparatus according to claim 1, wherein the storage stores the characteristic value output from the characteristic value outputting section each time the characteristic value is output, the processor executes the control program to function to further include a lifetime predicting section, and the lifetime predicting section predicts a time of finish of lifetime of the developer in the developing device based on a transition of the characteristic value stored on the storage, and output lifetime information on the predicted time of finish of lifetime.

9. The image forming apparatus according to claim 1, wherein the storage stores thereon in advance reference information on a gradient of a reference straight line that represents a relationship of a change amount in the density of the toner image with respect to a change amount in a frequency of the AC voltage of the developing bias in the case where the frequency is changed in the state in which a potential difference in the DC voltage between the developing roller and the image bearing member is kept constant, the reference information being stored for each of the charge amounts of the toner, and the charge amount acquiring section forms the plurality of measurement toner images on the image bearing member while changing the frequency of the AC voltage of the developing bias in the state in which the potential difference in the DC voltage between the developing roller and the image bearing member is kept constant, acquires a gradient of a measurement straight line that represents a relationship of the change amount in the density of each of the plurality of measurement toner images with respect to the change amount in the frequency, based on the change amount in the frequency and results of detection on the density of each of the plurality of measurement toner images provided by the first density sensor, and acquires the charge amount of the toner contained in each of the plurality of measurement toner images formed on the image bearing member based on the acquired gradient of the measurement straight line and the reference information stored on the storage.

10. The image forming apparatus according to claim 9, wherein the reference information stored on the storage is set such that the reference straight line has a negative gradient in the case where the charge amount of the toner is a first virtual charge amount, such that the reference straight line has a positive gradient in the case where the charge amount of the toner is a second virtual charge amount smaller than the first virtual charge amount, and such that the gradient of the reference straight line is increased as the charge amount of the toner is decreased.

11. The image forming apparatus according to claim 1, wherein the charge amount acquiring section forms the plurality of measurement toner images on the image bearing member while changing the frequency of the AC voltage of the developing bias in the state in which a potential difference in the DC voltage between the developing roller and the image bearing member is kept constant, and acquires the charge amount of the toner contained in each of the plurality of measurement toner images formed on the image bearing member based on a ratio of a difference in the DC component among the developing currents flowing between the developing roller and the developing bias applying section at the time of formation of the plurality of measurement toner images with respect to a difference in the density among the plurality of measurement toner images detected by the first density sensor.

12. The image forming apparatus according to claim 1, wherein the charge amount acquiring section forms the plurality of measurement toner images on the image bearing member while changing a coverage rate per unit area by controlling the exposure device in the state in which a potential difference in the DC voltage between the developing roller and the image bearing member is kept constant, and acquires the charge amount of the toner contained in each of the plurality of measurement toner images formed on the image bearing member, based on a ratio of a difference in the DC component among the developing currents flowing between the developing roller and the developing bias applying section at the time of formation of the plurality of measurement toner images with respect to a difference in the density among the plurality of measurement toner images detected by the first density sensor.

13. An image forming apparatus, comprising:

an image bearing member that is rotatable, that is configured to allow an electrostatic latent image to be formed on a surface thereof and bear a toner image obtained as a result of the electrostatic latent image being made visible;

a charger configured to charge the image bearing member with a predetermined charge potential;

an exposure device configured to expose the surface of the image bearing member charged with the predetermined charge potential to light according to predetermined image information to form the electrostatic latent image;

a developing device located opposite to the image bearing member in a predetermined developing nip part, the developing device including a rotatable developing roller that is rotatable, that is configured to form the toner image by bearing a developer on a circumferential surface thereof and supplying the toner to the image bearing member having the electrostatic latent image formed thereon, the developer containing a toner and a carrier;

a developing bias applying section configured to apply a developing bias to the developing roller, the developing bias including an AC voltage superposed on an DC voltage;

a first density sensor configured to detect a density of the toner image;

an ammeter configured to measure a DC component of a developing current flowing between the developing roller and the developing bias applying section;

storage that stores predetermined information and a control program thereon; and a processor, wherein the processor executes the control program to function to include a charge amount acquiring section, a characteristic value outputting section, and an execution timing determining section, the charge amount acquiring section controls the charger, the exposure device, and the developing bias applying section at a predetermined execution timing during a non-development operation time period to form a plurality of measurement toner images developed with different amounts of the toner from each other on the image bearing member, and executes a charge amount acquisition operation of acquiring a charge amount of the toner contained in each of the plurality of measurement toner images formed on the image bearing member, based on the density of each of the plurality of measurement toner images detected by the first density sensor, or based on a DC component of the developing current measured by the ammeter at the time of formation of the plurality of measurement toner images as well as based on the density of each of the plurality of measurement toner images, the non-development operation time period being different from a development operation time period in which the toner image is formed on the image bearing member, the characteristic value outputting section acquires the DC component of the developing current measured by the ammeter at a predetermined measurement timing, and outputs a characteristic value according to the DC component of the developing current, the predetermined measurement timing being a timing at which a non-image forming region of the surface of the image bearing member faces the developing roller in the entirety of an axial direction and an electric field in a direction in which the toner moves from the image bearing member toward the developing roller by a potential difference between a surface potential of the image bearing member and the DC component of the developing bias is formed in the developing nip part, the execution timing determining section determines the execution timing for the charge amount acquisition operation according to the characteristic value output by the characteristic value outputting section, the image forming apparatus further comprises a second density sensor that is located at the developing device and that is configured to detect a toner density that represents a ratio of an amount of the toner with respect to an amount of the carrier contained in the developer accommodated in the developing device, and the execution timing determining section changes the characteristic value threshold value according to an absolute value of a difference between a logical product of a first toner charge amount and a first toner density and a logical product of a second toner charge amount and a second toner density, the first toner charge amount being is the charge amount of the toner acquired at a first execution timing, the first toner density being is the toner density detected at the first execution timing, the second toner charge amount being the charge amount of the toner acquired at a second execution timing after the first execution timing, the second toner density being the toner density detected at the second execution timing.

14. An image forming apparatus, comprising:

an image bearing member that is rotatable, that is configured to allow an electrostatic latent image to be formed on a surface thereof and bear a toner image obtained as a result of the electrostatic latent image being made visible;

a charger configured to charge the image bearing member with a predetermined charge potential;

an exposure device configured to expose the surface of the image bearing member charged with the predetermined charge potential to light according to predetermined image information to form the electrostatic latent image;

a developing device located opposite to the image bearing member in a predetermined developing nip part, the developing device including a rotatable developing roller that is rotatable, that is configured to form the toner image by bearing a developer on a circumferential surface thereof and supplying the toner to the image bearing member having the electrostatic latent image formed thereon, the developer containing a toner and a carrier;

a developing bias applying section configured to apply a developing bias to the developing roller, the developing bias including an AC voltage superposed on an DC voltage;

a density sensor configured to detect a density of the toner image;

an ammeter configured to measure a DC component of a developing current flowing between the developing roller and the developing bias applying section;

storage that stores predetermined information and a control program thereon; and a processor, wherein the processor executes the control program to function to include a charge amount acquiring section, a characteristic value outputting section, and an execution timing determining section, the charge amount acquiring section controls the charger, the exposure device, and the developing bias applying section at a predetermined execution timing during a non-development operation time period to form a plurality of measurement toner images developed with different amounts of the toner from each other on the image bearing member, and executes a charge amount acquisition operation of acquiring a charge amount of the toner contained in each of the plurality of measurement toner images formed on the image bearing member, based on the density of each of the plurality of measurement toner images detected by the density sensor, or based on a DC component of the developing current measured by the ammeter at the time of formation of the plurality of measurement toner images as well as based on the density of each of the plurality of measurement toner images, the non-development operation time period being different from a development operation time period in which the toner image is formed on the image bearing member, the characteristic value outputting section acquires the DC component of the developing current measured by the ammeter at a predetermined measurement timing, and outputs a characteristic value according to the DC component of the developing current, the predetermined measurement timing being a timing at which a non-image forming region of the surface of the image bearing member faces the developing roller in the entirety of an axial direction and an electric field in a direction in which the toner moves from the image bearing member toward the developing roller by a potential difference between a surface potential of the image bearing member and the DC component of the developing bias is formed in the developing nip part, the execution timing determining section determines the execution timing for the charge amount acquisition operation according to the characteristic value output by the characteristic value outputting section, the storage stores thereon in advance reference information on a gradient of a reference straight line that represents a relationship of a change amount in the density of the toner image with respect to a change amount in a frequency of the AC voltage of the developing bias in the case where the frequency is changed in the state in which a potential difference in the DC voltage between the developing roller and the image bearing member is kept constant, the reference information being stored for each of the charge amounts of the toner, and the charge amount acquiring section forms the plurality of measurement toner images on the image bearing member while changing the frequency of the AC voltage of the developing bias in the state in which the potential difference in the DC voltage between the developing roller and the image bearing member is kept constant, acquires a gradient of a measurement straight line that represents a relationship of the change amount in the density of each of the plurality of measurement toner images with respect to the change amount in the frequency, based on the change amount in the frequency and results of detection on the density of each of the plurality of measurement toner images provided by the density sensor, and acquires the charge amount of the toner contained in each of the plurality of measurement toner images formed on the image bearing member based on the acquired gradient of the measurement straight line and the reference information stored on the storage.

15. An image forming apparatus, comprising:

an image bearing member that is rotatable, that is configured to allow an electrostatic latent image to be formed on a surface thereof and bear a toner image obtained as a result of the electrostatic latent image being made visible;

a charger configured to charge the image bearing member with a predetermined charge potential;

an exposure device configured to expose the surface of the image bearing member charged with the predetermined charge potential to light according to predetermined image information to form the electrostatic latent image;

a developing device located opposite to the image bearing member in a predetermined developing nip part, the developing device including a rotatable developing roller that is rotatable, that is configured to form the toner image by bearing a developer on a circumferential surface thereof and supplying the toner to the image bearing member having the electrostatic latent image formed thereon, the developer containing a toner and a carrier;

a developing bias applying section configured to apply a developing bias to the developing roller, the developing bias including an AC voltage superposed on an DC voltage;

a density sensor configured to detect a density of the toner image;

an ammeter configured to measure a DC component of a developing current flowing between the developing roller and the developing bias applying section;

storage that stores predetermined information and a control program thereon; and a processor, wherein the processor executes the control program to function to include a charge amount acquiring section, a characteristic value outputting section, and an execution timing determining section, the charge amount acquiring section controls the charger, the exposure device, and the developing bias applying section at a predetermined execution timing during a non-development operation time period to form a plurality of measurement toner images developed with different amounts of the toner from each other on the image bearing member, and executes a charge amount acquisition operation of acquiring a charge amount of the toner contained in each of the plurality of measurement toner images formed on the image bearing member, based on the density of each of the plurality of measurement toner images detected by the density sensor, or based on a DC component of the developing current measured by the ammeter at the time of formation of the plurality of measurement toner images as well as based on the density of each of the plurality of measurement toner images, the non-development operation time period being different from a development operation time period in which the toner image is formed on the image bearing member, the characteristic value outputting section acquires the DC component of the developing current measured by the ammeter at a predetermined measurement timing, and outputs a characteristic value according to the DC component of the developing current, the predetermined measurement timing being a timing at which a non-image forming region of the surface of the image bearing member faces the developing roller in the entirety of an axial direction and an electric field in a direction in which the toner moves from the image bearing member toward the developing roller by a potential difference between a surface potential of the image bearing member and the DC component of the developing bias is formed in the developing nip part, the execution timing determining section determines the execution timing for the charge amount acquisition operation according to the characteristic value output by the characteristic value outputting section, the charge amount acquiring section forms the plurality of measurement toner images on the image bearing member while changing the frequency of the AC voltage of the developing bias in the state in which a potential difference in the DC voltage between the developing roller and the image bearing member is kept constant, and acquires the charge amount of the toner contained in each of the plurality of measurement toner images formed on the image bearing member based on a ratio of a difference in the DC component among the developing currents flowing between the developing roller and the developing bias applying section at the time of formation of the plurality of measurement toner images with respect to a difference in the density among the plurality of measurement toner images detected by the density sensor.

16. An image forming apparatus, comprising:

an image bearing member that is rotatable, that is configured to allow an electrostatic latent image to be formed on a surface thereof and bear a toner image obtained as a result of the electrostatic latent image being made visible;

a charger configured to charge the image bearing member with a predetermined charge potential;

an exposure device configured to expose the surface of the image bearing member charged with the predetermined charge potential to light according to predetermined image information to form the electrostatic latent image;

a developing device located opposite to the image bearing member in a predetermined developing nip part, the developing device including a rotatable developing roller that is rotatable, that is configured to form the toner image by bearing a developer on a circumferential surface thereof and supplying the toner to the image bearing member having the electrostatic latent image formed thereon, the developer containing a toner and a carrier;

a developing bias applying section configured to apply a developing bias to the developing roller, the developing bias including an AC voltage superposed on an DC voltage;

a density sensor configured to detect a density of the toner image;

an ammeter configured to measure a DC component of a developing current flowing between the developing roller and the developing bias applying section;

storage that stores predetermined information thereon; and a processor, wherein the processor executes a control program to function to include a charge amount acquiring section, a characteristic value outputting section, and an execution timing determining section, the charge amount acquiring section controls the charger, the exposure device, and the developing bias applying section at a predetermined execution timing during a non-development operation time period to form a plurality of measurement toner images developed with different amounts of the toner from each other on the image bearing member, and executes a charge amount acquisition operation of acquiring a charge amount of the toner contained in each of the plurality of measurement toner images formed on the image bearing member, based on the density of each of the plurality of measurement toner images detected by the density sensor, or based on a DC component of the developing current measured by the ammeter at the time of formation of the plurality of measurement toner images as well as based on the density of each of the plurality of measurement toner images, the non-development operation time period being different from a development operation time period in which the toner image is formed on the image bearing member, the characteristic value outputting section acquires the DC component of the developing current measured by the ammeter at a predetermined measurement timing, and outputs a characteristic value according to the DC component of the developing current, the predetermined measurement timing being a timing at which a non-image forming region of the surface of the image bearing member faces the developing roller in the entirety of an axial direction and an electric field in a direction in which the toner moves from the image bearing member toward the developing roller by a potential difference between a surface potential of the image bearing member and the DC component of the developing bias is formed in the developing nip part, the execution timing determining section determines the execution timing for the charge amount acquisition operation according to the characteristic value output by the characteristic value outputting section, the charge amount acquiring section forms the plurality of measurement toner images on the image bearing member while changing a coverage rate per unit area by controlling the exposure device in the state in which a potential difference in the DC voltage between the developing roller and the image bearing member is kept constant, and acquires the charge amount of the toner contained in each of the plurality of measurement toner images formed on the image bearing member, based on a ratio of a difference in the DC component among the developing currents flowing between the developing roller and the developing bias applying section at the time of formation of the plurality of measurement toner images with respect to a difference in the density among the plurality of measurement toner images detected by the density sensor.

* * * * *